US011661696B2

(12) United States Patent
Lee et al.

(10) Patent No.: US 11,661,696 B2
(45) **Date of Patent: *May 30, 2023**

(54) LAUNDRY TREATING APPARATUS

(71) Applicant: LG Electronics Inc., Seoul (KR)

(72) Inventors: Jihong Lee, Seoul (KR); Kwanwoong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/383,903

(22) Filed: Jul. 23, 2021

(65) Prior Publication Data

US 2022/0120022 A1 Apr. 21, 2022

(30) Foreign Application Priority Data

Oct. 15, 2020 (KR) ..... 10-2020-0133272

(51) Int. Cl.

| | |
|---|---|
| ***D06F 37/28*** | (2006.01) |
| ***D06F 23/04*** | (2006.01) |
| ***D06F 39/14*** | (2006.01) |
| ***D06F 37/18*** | (2006.01) |
| ***D06F 37/26*** | (2006.01) |
| *D06F 39/12* | (2006.01) |

(52) U.S. Cl.

CPC ..... *D06F 37/28* (2013.01); *D06F 37/18* (2013.01); *D06F 37/266* (2013.01); *D06F 39/14* (2013.01); *D06F 23/04* (2013.01); *D06F 39/125* (2013.01)

(58) Field of Classification Search

CPC ..... D06F 23/04; D06F 37/18; D06F 37/28; D06F 37/266; D06F 39/14

See application file for complete search history.

(56) References Cited

U.S. PATENT DOCUMENTS

2011/0298338 A1* 12/2011 Kim ..... D06F 29/00 312/109
2017/0002494 A1* 1/2017 Lee ..... D06F 39/00

(Continued)

FOREIGN PATENT DOCUMENTS

EP 3339493 A1 * 6/2018 ..... A47L 15/4214
EP 3265599 8/2019

(Continued)

OTHER PUBLICATIONS

Extended European Search Report in International Appln. No. 21186549.8, dated Dec. 14, 2021, 10 pages.

*Primary Examiner* — Joseph L. Perrin

(74) *Attorney, Agent, or Firm* — Fish & Richardson P.C.

(57) ABSTRACT

Disclosed is a laundry treating apparatus including a cabinet having a front face with a drawer hole defined therein, and a rear cover for forming a rear face of the cabinet, a drawer including a drawer body, a drawer cover, and a cover through-hole defined to penetrate the drawer cover, a tub including a tub body, a tub cover for forming a top face of the tub body, and an inlet defined to penetrate the tub cover, a drum rotatably disposed in the tub, wherein the drum accommodates laundry, a door for closing the inlet, and a door guide for providing a path for the door to reciprocate between a first point where the inlet is closed and a second point where the inlet is opened in a space defined between the tub cover and the drawer cover.

19 Claims, 18 Drawing Sheets

(56) References Cited

U.S. PATENT DOCUMENTS

| | | | | |
|---|---|---|---|---|
| 2018/0023241 | A1* | 1/2018 | Lee | E05C 19/16<br>312/333 |
| 2019/0112743 | A1* | 4/2019 | Kim | D06F 29/00 |
| 2019/0194852 | A1* | 6/2019 | Lee | D06F 39/12 |
| 2021/0180239 | A1* | 6/2021 | Mcconnell | D06F 29/00 |

FOREIGN PATENT DOCUMENTS

| | | |
|---|---|---|
| EP | 2430227 | 2/2020 |
| EP | 3835474 | 6/2021 |
| JP | 2002282192 | 10/2002 |
| WO | WO2020085695 | 4/2020 |

* cited by examiner

LAUNDRY TREATING APPARATUS

CROSS-REFERENCE TO RELATED APPLICATION

This application claims the benefit of Korean Patent Application No. 10-2020-0133272, filed on Oct. 15, 2020, which is hereby incorporated by reference as if fully set forth herein.

TECHNICAL FIELD

The present disclosure relates to a laundry treating apparatus.

BACKGROUND

A laundry treating apparatus is a concept including a washing machine for washing laundry (an object to be washed), a dryer for drying the laundry (an object to be dried), and a complex apparatus that performs both the washing and the drying of the laundry. Among conventional laundry treating apparatuses, there is a drawer-type laundry treating apparatus that is located beneath another apparatus (the washing machine, the dryer, or the complex apparatus) and performs the washing of the laundry.

The drawer-type laundry treating apparatus is constructed to include a cabinet, a drawer extending from the cabinet, a tub that is disposed in the drawer and stores water therein, a drum that is rotatably disposed inside the tub and stores laundry therein, a water supply pipe that supplies the water to the tub, and a drain pipe that drains the water inside the tub.

The drawer-type laundry treating apparatus described above has a risk that the water supply pipe or the drain pipe is twisted inside the cabinet when the drawer is extended from the cabinet or retracted into the cabinet. To solve such problem, among the conventional laundry treating apparatuses, there was one equipped with a support that supports the water supply pipe and the drain pipe inside the cabinet (Korean Patent Application Publication No. 10-2015-0138017).

The support disposed in the conventional drawer-type laundry treating apparatus is constructed to include a first support bar rotatably fixed to the cabinet, and a second support bar having one end rotatably fixed to the drawer and the other end connected to the first support.

Because the conventional support maintains a state in which the first support bar and the second support bar are connected to each other via a connection shaft, the support part becomes to serve as means for transmitting vibration of the drawer (vibration resulted from rotation of the drum, vibration resulted from movement of the drawer, and the like) to the cabinet. In addition, when the vibration of the drawer is transmitted to the connection shaft, durability of the connection shaft may be lowered.

In one example, among the conventional drawer-type laundry treating apparatuses, there were an apparatus having means for supplying detergent to the tub (Korean Patent No. 10-1932471), an apparatus having means for minimizing the water remaining in the tub through a tub exhaust pipe that communicates an interior of the tub with the outside (Korean Patent Application Publication No. 10-2020-0069732), and an apparatus having a pump exhaust pipe that reduces noise of a pump that drains the water stored in the tub. However, in the conventional drawer-type laundry treating apparatus, the means for supplying the water to the tub, the tub exhaust pipe, and the pump exhaust pipe were not able to be designed as an integrated structure, but were only constituted as independent apparatuses.

SUMMARY

The present application is to provide a laundry treating apparatus that includes a drawer extended from a cabinet, a tub disposed in the drawer to store water therein, a drum disposed inside the tub to store laundry therein, and a door that opens and closes an inlet defined in the tub, and is able to open the inlet even when the door is not withdrawn to the outside of the cabinet.

In addition, the present application is to provide a laundry treating apparatus that may minimize a risk of opening an inlet by a door by vibration.

In addition, the present application is to provide a laundry treating apparatus that may maximize a contact area and a contact point between a gasket and an inlet, thereby achieving a high sealing force of the inlet.

One aspect of the present disclosure proposes a laundry treating apparatus including a cabinet having a front face with a drawer hole defined therein, and a rear cover for forming a rear face of the cabinet, a drawer including a drawer body extendable from the cabinet through the drawer hole, a drawer cover for forming a top face of the drawer body, and a cover through-hole defined to penetrate the drawer cover, wherein the cover through-hole is exposed to the outside of the cabinet when the drawer body is extended from the cabinet, a tub including a tub body disposed inside the drawer and storing water therein, a tub cover for forming a top face of the tub body, and an inlet defined to penetrate the tub cover, wherein the inlet is exposed to the outside of the drawer through the cover through-hole, a drum rotatably disposed in the tub, wherein the drum accommodates laundry, a door for closing the inlet, and a door guide for providing a path for the door to reciprocate between a first point where the inlet is closed and a second point where the inlet is opened in a space defined between the tub cover and the drawer cover.

In one implementation, the door may include a door frame for closing the inlet and a slide fixed to the door frame, and the door guide may include a detachment path for guiding the slide in a direction from the tub cover to the drawer cover, and a transfer path for guiding the slide from the detachment path to a rear portion of the tub cover.

In one implementation, the detachment path may be inclined to be away from the tub cover in a direction from the inlet to the rear portion of the tub cover.

In one implementation, the door guide may include a first guide and a second guide extending from a front portion of the tub cover toward a rear portion of the tub cover, and being parallel to each other with the inlet interposed therebetween, and the door may include a door frame for closing the inlet, a first slide fixed to the door frame and connected to the first guide, and a second slide fixed to the door frame and connected to the second guide.

In one implementation, the first guide may include a first detachment path for guiding the first slide in a direction from the tub cover to the drawer cover, and a first transfer path for guiding the first slide from the first detachment path to a rear portion of the tub cover, and the second guide may include a second detachment path for guiding the second slide in the direction from the tub cover to the drawer cover, and a second transfer path for guiding the second slide from the second detachment path to the rear portion of the tub cover.

In one implementation, the door guide may include a first guide and a second guide extending from a front portion of the tub cover toward a rear portion of the tub cover, and facing each other with the inlet interposed therebetween, and a third guide extending from a rear end of the inlet toward a rear end of the tub cover, and positioned between the first guide and the second guide, and the door may include a door frame for closing the inlet, a first slide fixed to the door frame and connected to the first guide, a second slide fixed to the door frame and connected to the second guide, and a third slide fixed to the door frame and connected to the third guide.

In one implementation, the first guide may include a first detachment path for guiding the first slide in a direction from the tub cover to the drawer cover, and a first transfer path for guiding the first slide from the first detachment path to a rear portion of the tub cover, the second guide may include a second detachment path for guiding the second slide in the direction from the tub cover to the drawer cover, and a second transfer path for guiding the second slide from the second detachment path to the rear portion of the tub cover, and the third guide may include a third detachment path for guiding the third slide in the direction from the tub cover to the drawer cover, and a third transfer path for guiding the third slide from the third detachment path to the rear end of the tub cover.

In one implementation, at least one of the first transfer path, the second transfer path, and the third transfer path may be inclined such that a rear end of the door located at the second point is located at a higher point than a front end of the door.

In one implementation, the third transfer path may be inclined to be away from the tub cover in a direction from the inlet to the rear end of the tub cover.

In one implementation, the laundry treating apparatus may further include a stopper defined in the door, and a stopper fastening portion disposed on the tub cover, wherein the stopper fastening portion is coupled to the stopper to limit a movement of the door when the door reaches the first point.

In one implementation, the stopper fastening portion may include a stopper guide for guiding the stopper in a direction from the drawer cover to the tub cover, and an inclination angle of the stopper guide may be set equal to an inclination angle of the detachment path.

In one implementation, the laundry treating apparatus may further include a position sensing portion disposed on the tub cover to sense at least one of whether the door is positioned at the first point and whether the door is positioned at the second point.

In one implementation, the position sensing portion may include a pressing portion protruding from the door toward the tub cover, and a signal generator disposed on the tub cover and generating a control signal when the pressing portion is in contact therewith, and the pressing portion and the signal generator may be constructed to be in contact with each other when the door is positioned at the first point.

In one implementation, the second point may be set as a point where 80% or more of the inlet is open.

The present application provides the laundry treating apparatus that includes the drawer extended from the cabinet, the tub disposed in the drawer to store the water therein, the drum disposed inside the tub to store the laundry therein, and the door that opens and closes the inlet defined in the tub, and is able to open the inlet even when the door is not withdrawn to the outside of the cabinet.

In addition, the present application provides the laundry treating apparatus that may minimize the risk of opening the inlet by the door by the vibration.

In addition, the present application provides the laundry treating apparatus that may maximize the contact area and the contact point between the gasket and the inlet, thereby achieving the high sealing force of the inlet.

DETAILED DESCRIPTION

Reference will now be made in detail to the preferred embodiments of the present disclosure, examples of which are illustrated in the accompanying drawings. Meanwhile, elements or control method of apparatuses which will be described below are only intended to describe the embodiments of the present disclosure and are not intended to restrict the scope of the present disclosure. Wherever possible, the same reference numbers will be used throughout the drawings to refer to the same or like parts.

Figure 1:
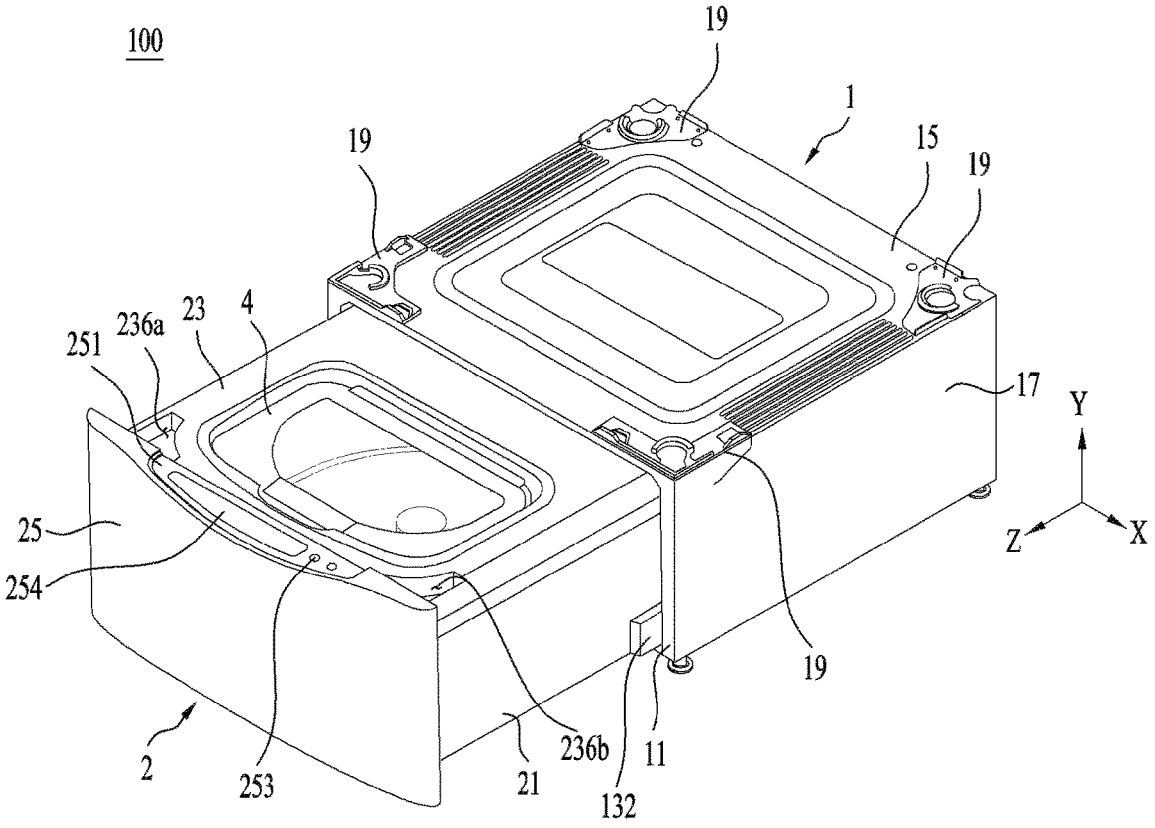
FIG. 1 shows an example of a laundry treating apparatus.

As shown in FIG. 1, a laundry treating apparatus 100 is constructed to include a cabinet 1, a drawer 2 extended from the cabinet, an accommodating portion 3 disposed inside the drawer to define therein a space in which water and laundry are accommodated, and a door 4 that opens and closes the accommodating portion.

Figure 2:
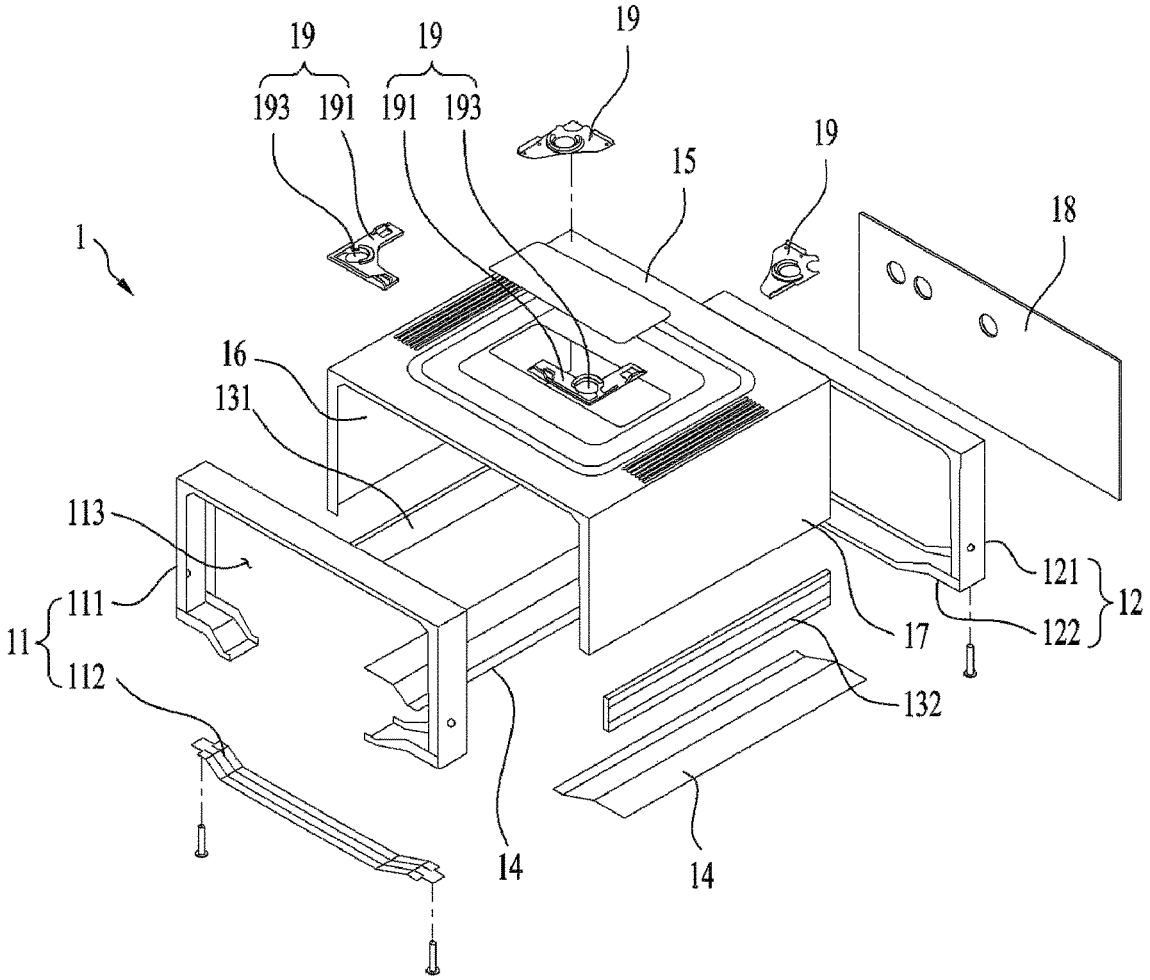
FIG. 2 shows an example of a cabinet.

As shown in FIG. 2, the cabinet 1 may be constructed to form an appearance of the laundry treating apparatus. In this case, the cabinet 1 may be constructed to include a top cover 15 that forms a top face of the laundry treating apparatus 100, a first side cover 16 and a second side cover 17 respectively disposed at opposite ends of the top cover to respectively form both side faces of the laundry treating apparatus, and a rear cover 18 that forms a rear face. The top cover 15, the first side cover 16, and the second side cover 17 may be formed by bending opposite ends of one metal plate.

A drawer hole 113 for the extension and retraction of the drawer 2 may be defined in a front face of the cabinet 1. The drawer hole 113 may be defined by forming the front face of the cabinet as an open face, and may be defined as a through-hole penetrating a front cover that forms the front face of the cabinet.

To minimize vibration of the covers 15, 16, and 17 resulted from vibration occurring in the accommodating portion 3, and to firmly support the drawer 2, the cabinet 1 may include a front frame 11, a rear frame 12, and a frame connector 14 that support the covers 15, 16, 17, and 18.

The front frame 11 may be located at a front portion of the cabinet 1, the rear frame 12 may be located at a rear portion of the cabinet 1, and the frame connector 14 may be constructed to connect a bottom face of the front frame 11 with a bottom face of the rear frame 12.

The front frame 11 may be constructed to include a frame first body 111 and a first support frame 112. The frame first body 111 may be formed in a C shape with a face on which a front face of the top cover 15 is fixed, a face on which a front face of the first side cover 16 is fixed, and a face on which a front face of the second side cover 17 is fixed. The first support frame 112 may be constructed to connect both ends (two free ends) of the frame first body 111 with each other.

When the frame first body 111 and the first support frame 112 having the above-described structures are coupled to each other, a frame through-hole is defined at a center. The drawer hole 113 may be defined as the frame through-hole.

The rear frame 12 may be constructed to include a frame second body 121 and a second support frame 122. The frame second body 121 may be formed in a C shape with a face on which a rear face of the top cover 15 is fixed, a face on which a rear face of the first side cover is fixed, and a face on which a rear face of the second side cover is fixed. The second support frame 122 may be constructed to connect both ends (two free ends) of the frame second body 121 with each other.

The frame connector 14 may include a first frame connector that connects the first support frame 112 with the second support frame 122 and is fixed at a portion at which the first side cover 16 is located, and a second frame connector that connects the first support frame 112 with the second support frame 122 and is fixed at a portion at which the second side cover 17 is located.

The rear cover 18 may be detachably fixed to the rear frame 12, and each of the first support frame 112 and the second support frame 122 may have a leg in contact with a face on which the cabinet 1 is mounted.

The top cover 15 may have a mounting portion 19. The mounting portion 19 is means for fixing each apparatus to the top cover 15 when another laundry treating apparatus (a washing machine, a dryer, and the like) or a storage apparatus is mounted on the top cover 15. The mounting portion 19 may be constructed to include each mounting body 191 fixed to each corner of the top cover 15 and a leg fastening portion 193 defined in the mounting body.

The leg fastening portion 193 is means for coupling a leg disposed on a bottom face of the apparatus (a separate laundry treating apparatus or the like) to be mounted on the top cover to the mounting body 191. The leg fastening portion 193 may be defined as a mounting body through-hole defined to penetrate the mounting body 191, or a mounting body groove defined by concavely bending a surface of the mounting body 191 toward the top cover 15.

Figure 3:
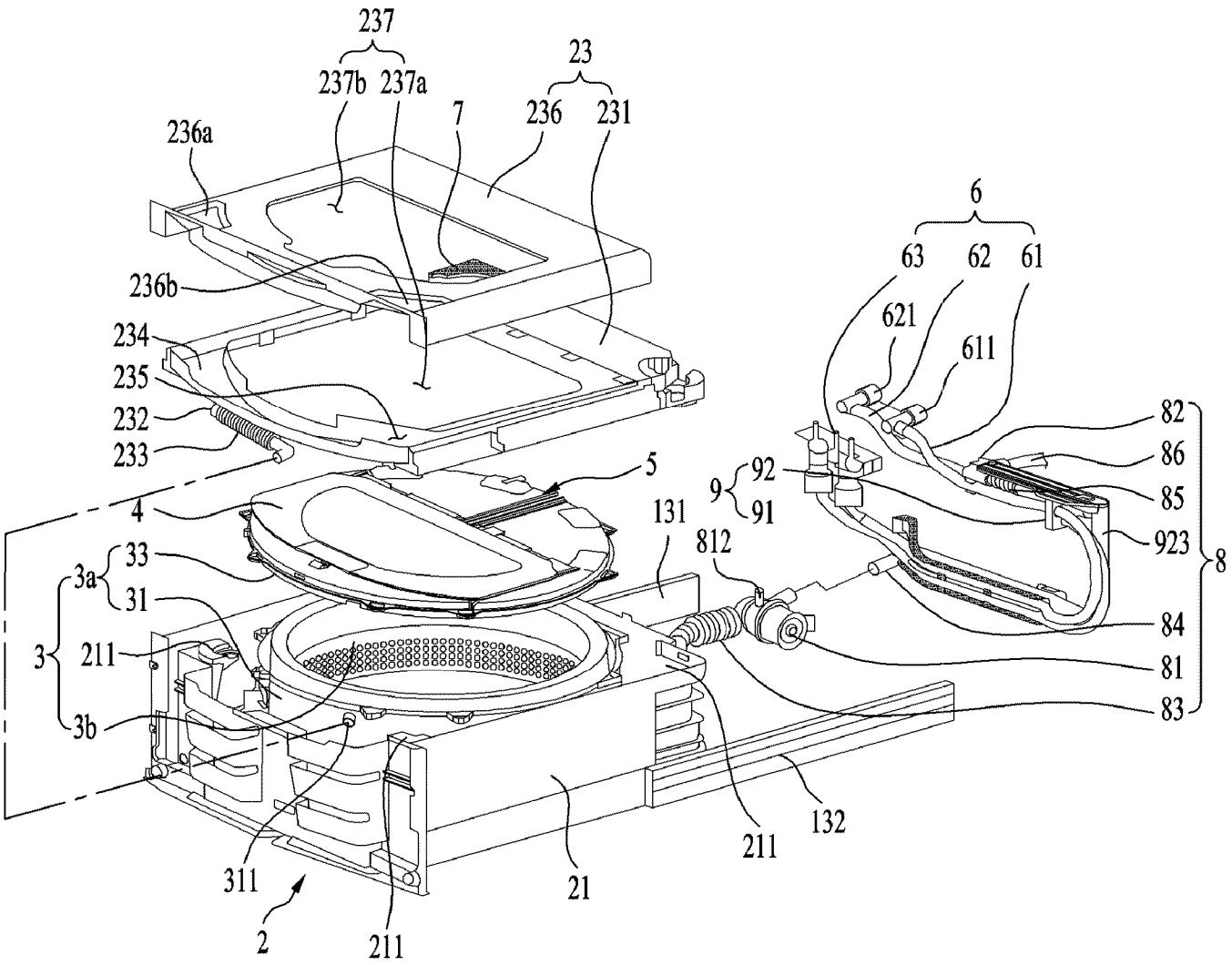
FIG. 3 shows an example of a drawer, a tub, a drum, a water supply, and a drainage.

As shown in FIG. 3, a drawer 3 may be constructed to include a drawer body 21 that is formed in a shape extendable from the cabinet 1, and provides therein a space in which the accommodating portion 3 is fixed, a drawer cover 23 that forms a top face of the drawer body 21, and a drawer panel 25 (see FIG. 1) fixed to the drawer body 21 and located outside the cabinet 1.

The drawer body 21 may be formed in any shape capable of being extended from the cabinet 1 through the drawer hole 113. FIG. 3 shows a case in which the drawer body 21 is formed in a hexahedral shape with an open top face as an example. The drawer cover 23 is fixed to the open face of the drawer body 21, and the drawer panel 25 is fixed to a front face of the drawer body 21.

The drawer body 21 may be fixed to the cabinet 1 in an extendable manner through drawer supports 131 and 132. That is, as shown in FIG. 2, a first side face (a face facing the first side cover) of the drawer body 21 may be fixed to the cabinet 1 through a drawer first support 131, and a second side face (a face facing the second side cover) of the drawer body 21 may be fixed to the cabinet 1 through a drawer second support 132.

The drawer first support 131 may include a first fixed frame fixed to the front frame 11 and the rear frame 12, and a first sliding frame coupled to the first fixed frame in the extendable manner and fixed to the first side face of the drawer body 21. Similarly, the drawer second support 132 may include a second fixed frame fixed to the front frame 11 and the rear frame 12, and a second sliding frame coupled to the second fixed frame in the extendable manner and fixed to the second side face of the drawer body 21.

As shown in FIG. 1, the drawer panel 25 may be formed in a shape capable of opening the drawer hole 113 when the drawer body 21 is extended from the cabinet 1, and closing the drawer hole 113 when the drawer body 21 is retracted into the cabinet 1. The fact that the drawer hole 113 is opened by the drawer panel 25 means that the drawer hole 113 is exposed to the outside of the laundry treating apparatus, and the fact that the drawer hole 113 is closed means that the drawer hole 113 is not exposed to the outside of the laundry treating apparatus (This does not mean that the drawer hole must be sealed or the drawer panel must be constructed to seal edges of the drawer hole).

A control panel 251 is disposed on one face of the drawer panel 25. An input unit 253 and a display 254 may be disposed on the control panel 251. The input unit 253 is means for receiving a control command from a user, and the display 254 is means for providing the user with various information related to operation of the laundry treating apparatus.

As shown in FIG. 3, the drawer cover 23 may be constructed to include a first cover 231 fixed to the top face of the drawer body 21, and a second cover 236 fixed to the first cover.

The drawer cover 23 includes a cover through-hole 237 defined therein for communicating an interior of the drawer body 21 with the outside. The cover through-hole 237 may be defined by coupling a first through-hole **237*a* penetrating the first cover with a second through-hole 237*b* penetrating the second cover 236**.

The second cover 236 has a detergent supply hole to which detergent is introduced. FIG. 3 shows a case in which the detergent supply hole is defined as a first detergent supply hole **236*a* and a second detergent supply hole 236*b* as an example. The first detergent supply hole 236*a* and the second detergent supply hole 236*b* are defined in a space exposed to the outside when the drawer body 21 is extended from the cabinet 1 of a space provided by the drawer cover 23. FIG. 3 shows a case in which the first detergent supply hole 236*a* is defined to be located at a right front portion of the second cover 236 (a region close to the drawer panel in a right space of the second cover), and the second detergent supply hole 236***b* is located at a left front portion of the second cover 236 as an example.

Figure 4:
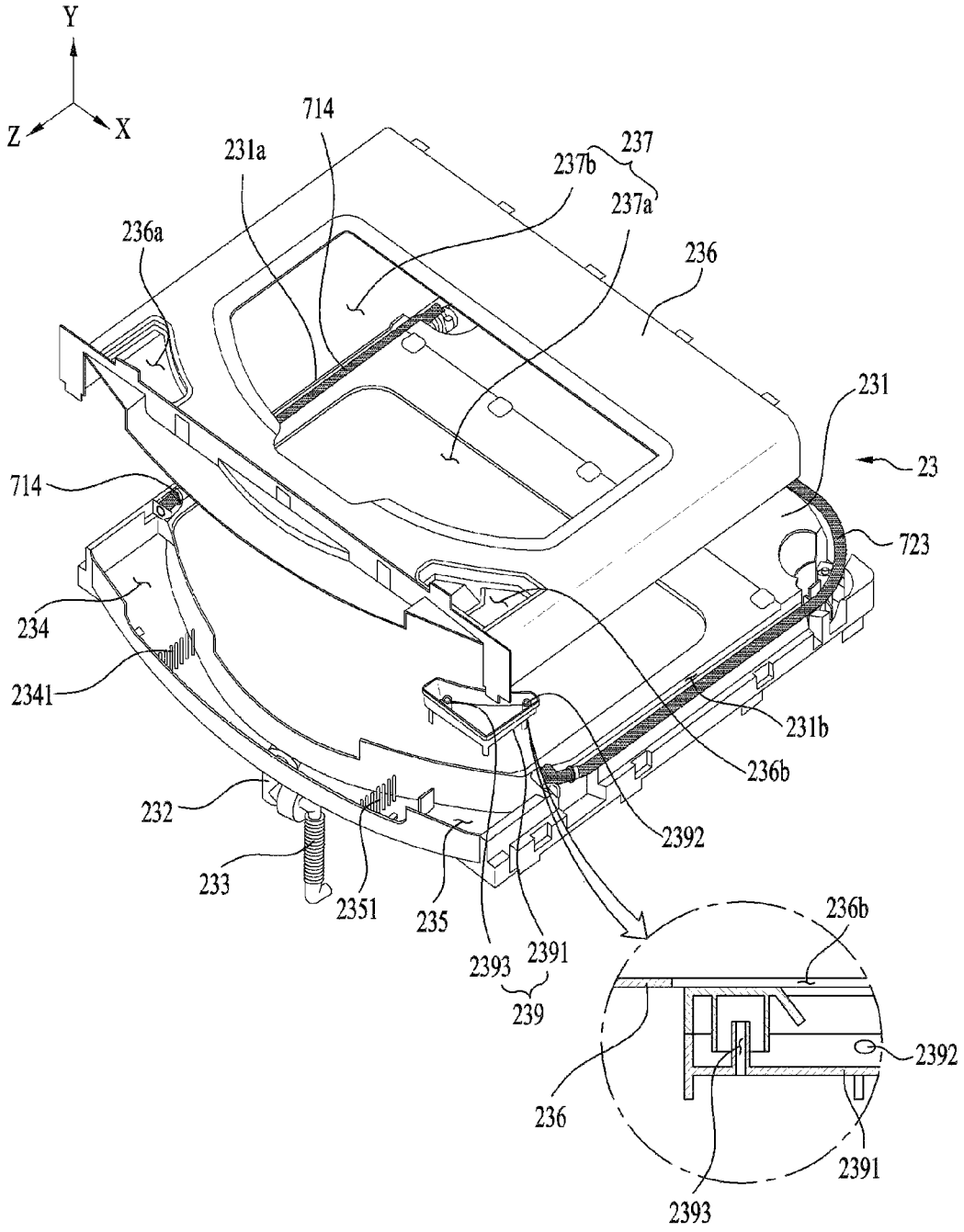
FIG. 4 shows an example of a drawer cover.

As shown in FIG. 4, the first cover 231 includes detergent flow channels 232, 233, 234, and 235 that guide the detergent introduced into the detergent supply hole to the accommodating portion 3. The detergent flow channels may include a discharge flow channel 232 and 233 that connect the accommodating portion 3 with the first cover 231, a first detergent flow channel 234 that guides the detergent introduced into the first detergent supply hole 236*a* to the discharge flow channel, and a second detergent flow channel 235 that guides the detergent introduced into the second detergent supply hole 236*b* to the discharge flow channel.

The discharge flow channel 232 and 233 may be constructed to include a discharge hole 232 defined to penetrate the first cover 231, and a discharge pipe 233 that connects the discharge hole 232 and the accommodating portion 3 with each other. In this case, one end of the first detergent flow channel 234 and one end of the second detergent flow channel 235 may be connected to the discharge hole 232 defined at a center of a front portion of the first cover 231. In order to minimize the vibration of the accommodating portion 3 from being transmitted to the drawer cover 23, the discharge pipe 233 may be formed as a corrugate pipe.

At least one of the first detergent flow channel 234 and the second detergent flow channel 235 may have a detergent storage 239 that provides therein a space for storing the detergent. FIG. 4 shows a case in which the detergent storage 239 is disposed at the second detergent flow channel 235.

The detergent storage 239 may be constructed to include a storage body 2391 detachable from the drawer cover 23 through the second detergent supply hole 236*b*, a water trap 2393 disposed to penetrate a bottom face of the storage body 2391, and a storage body water supply port 2392 that supplies water to the storage body 2391.

Because the storage body 2391 has a storage body inlet in communication with the second detergent supply hole 236*b* defined in a top face thereof, the detergent introduced into the second detergent supply hole 263*b* may flow to the storage body 2391 through the storage body inlet.

The water trap 2393 may be constructed to discharge the water and the detergent inside the storage body 2391 to the second detergent flow channel 235 using a siphon phenomenon. That is, the water trap 2393 may be formed in any shape as long as the water and the detergent may be discharged to the second detergent flow channel 235 when a water level inside the storage body 2391 is equal to or higher than a preset reference water level. FIG. 4 shows a case in which the water trap 2393 is formed as a storage body discharge pipe protruding from the bottom face of the storage body 2391 and a cap constructed to surround a free end of the storage body discharge pipe as an example.

The storage body water supply port 2392 receives the water through a water supply 6 and 7. A detailed description of the water supply will be described later.

Because the first detergent flow channel 234 and the second detergent flow channel 235 are in communication with an external space, foreign substances may be supplied to the accommodating portion 3 through the first detergent flow channel and the second detergent flow channel. In order to minimize a flow of foreign substances existing outside the drawer and foreign substances contained in the water or the detergent to the accommodating portion 3, a first foreign substance remover 2341 may be disposed in the first detergent flow channel 234, and a second foreign substance remover 2351 may be disposed in the second detergent flow channel 235.

The first foreign substance remover 2341 may be constructed as a number of protrusions protruding from the first cover 231 toward the second cover 236 are arranged along a width direction of the first detergent flow channel 234 (a Z-axis direction), and the second foreign substance remover 2351 may be constructed as a number of protrusions protruding from the first cover 231 toward the second cover 236 are arranged along a width direction of the second detergent flow channel 235 (the Z-axis direction).

As shown in FIG. 3, the accommodating portion 3 may be constructed to include a tub 3*a* that is fixed to the drawer body 21 and provides a space therein for storing the water, and a drum 3*b* that is rotatably disposed inside the tub and provides therein a space in which laundry is accommodated.

The tub 3*a* may be constructed to include a tub body 31 in which the water is stored, and a tub cover 33 that forms a top face of the tub body. The tub body 31 may be formed in a cylindrical shape with an open top face, and the tub cover 33 may be formed in a cylindrical shape with an open bottom face and be fixed to a top of the tub body 31.

Figure 5:
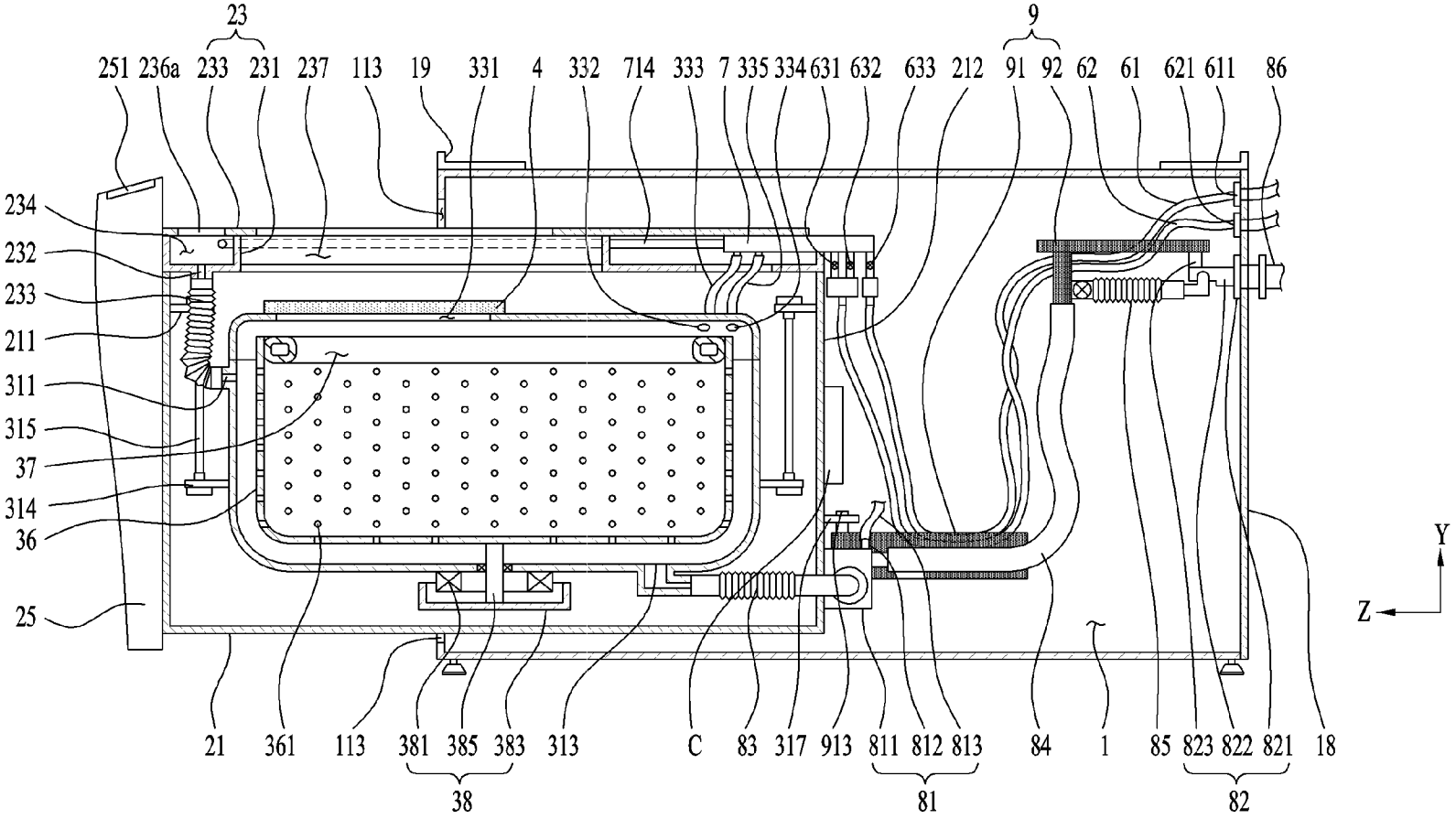
FIG. 5 shows an example of a cross-section of a laundry treating apparatus.

As shown in FIG. 5, the tub body 31 is fixed to the drawer body 21 through a tub support 315. The tub support 315 may be formed as a bar connecting a first bracket 211 disposed on the drawer body 21 and a second bracket 314 disposed on a circumferential face of the tub body.

A detergent supply hole 311 through which the detergent is supplied is defined in the circumferential face of the tub body 31, and a drain hole 313 through which the water inside the tub body is discharged may be defined in a bottom face of the tub body 31. One end of the discharge pipe 233 is fixed to the detergent supply hole 311.

In the tub cover 33, an inlet 331 communicating the interior of the tub body 31 with the outside, a water supply hole 332 that supplies the water to the tub body 31, and an exhaust hole 334 that discharges air inside the tub body 31 are defined. The inlet 331 is opened and closed by the door 4. A specific structure of the door 4 will be described later.

The tub cover 33 may be formed as an inlet defining body in which the inlet 331 is defined, and a cylindrical body extending from an edge of the inlet defining body toward the top of the tub body 31. In this case, the water supply hole 332 is preferably defined as a hole penetrating the cylindrical body. This is because, when the water supply hole 332 is defined to penetrate the inlet forming body, the water supply hole 332 may be clogged depending on an amount of the laundry stored in the drum 3*b* and an amount of the water supplied to the tub. With the same reason, it is referable that the exhaust hole 334 is also defined in the cylindrical body.

The drum 3*b* may be constructed to include a cylindrical drum body 36 with an empty inside, and a drum inlet 37 defined to penetrate a top face of the drum body.

The drum body 36 is rotatable inside the tub 3*a* through a driver 38. The driver 38 may be constructed to include a stator 381 fixed to the bottom face of the tub body 31 to form a rotating magnetic field, a rotor 383 rotating by the rotating magnetic field, and a rotation shaft 385 connecting a bottom face of the drum body 36 with the rotor 383 through a bottom face of the tub body.

A drum through-hole 361 is defined in a circumferential face, a bottom face, and the like of the drum body 36. Therefore, the water stored in the tub body 31 may be supplied into the drum body 36 through the drum through-hole 361, and water or foreign substances inside the drum body 36 may be discharged to the tub body 31 through the drum through-hole 361.

The drum inlet 37 is located below the inlet 331 that is opened and closed by the door 4, and the inlet 331 is located below the cover through-hole 237 defined in the drawer cover. In this case, when the drawer 2 is extended from the cabinet 1, the door 4 located below the cover through-hole 237 will be exposed to the outside of the cabinet 1. A user may open the door 4 to open the inlet 331. In such a state, the laundry may be supplied into the drum 3*b*, or the laundry stored in the drum may be withdrawn to the outside of the drawer.

As shown in FIG. 3, the tub 3*a* receives the water through the water supply 6 and 7, and the water stored in the tub 3*a* is discharged to the outside of the cabinet 1 through a drainage 8.

The drainage 8 may be constructed to include a pump 81 fixed to a rear face of the drawer body (a body rear face) 212 and connected to the tub body 31, and drain flow channels 84, 85, and 86 that guide the water discharged from the pump to the outside of the cabinet 1.

As shown in FIG. 5, the pump 81 may be constructed to include a housing 811 fixed to the body rear face 212, an impeller rotatable inside the housing, and a pump motor that is fixed to the housing and rotates the impeller.

The housing 811 is connected to the tub body 31 through a housing connection pipe 83. That is, the housing connection pipe 83 may be constructed to connect the drain hole 313 and the housing 811 with each other.

When air remains inside the housing 811, noise and vibration may occur when the impeller rotates. To prevent the air from remaining inside the housing 811, the pump 81 may further include a housing exhaust hole 812 defined to penetrate the housing. A housing exhaust pipe 813 is connected to the housing exhaust hole 812. The housing exhaust pipe 813 will be described later.

The housing exhaust hole 812 is preferably defined in an area located above a horizontal line passing through a rotation center of the impeller of a space provided by the housing 811. This is to minimize a risk that the water inside the housing is discharged through the housing exhaust hole 812 when the impeller is rotated.

The rear cover 18 includes a fixing member 82 that fixes the drain flow channels. The fixing member 82 may be constructed to include a fixing body 821 fixed to the rear cover 18, and a fixing pipe 822 that is disposed to penetrate the fixed body, and has one end inside the cabinet 1 and the other end outside the cabinet. In this case, the drain flow channels may be classified into drain pipes 84 and 85 that connect the housing 811 with the fixing pipe 822, and a drain pipe 86 extending from the fixing pipe 822 toward a sewer.

As shown in FIG. 3, the water supply may be constructed to include a water source connector 6 connected to a water source, and a dispenser 7 that supplies water supplied from the water supply source connector 6 to at least one of the tub 3*a* and the detergent flow channels 232, 233, 234, and 235.

As shown in FIG. 5, the water source connector 6 is constructed to be disposed between the rear cover 18 and the body rear face 212 and include connection flow channels 61 and 62 connected to the water source. When the water source is formed as a first water source that supplies water of a first temperature and a second water source that supplies water of a second temperature, the connection flow channels may include a first connection pipe 61 connected to the first water source and a second connection pipe 62 connected to the second water source. The first water source may be formed as a water supply facility (a faucet or the like) that supplies water of a room temperature, and the second water source may be formed as a water supply facility (the faucet or the like) that supplies water having a temperature higher than the room temperature.

The first connection pipe 61 may be connected to the first water source through a first water source connector 611, and the second connection pipe 62 may be connected to the second water source through a second water source connector 621. In this case, the first water source connector 611 and the second water source connector 621 may be fixed to the rear cover 18. That is, rear cover through-holes may be defined in the rear cover 18, and the water source connectors 611 and 621 may be respectively fixed to the rear cover through-holes.

Figure 6:
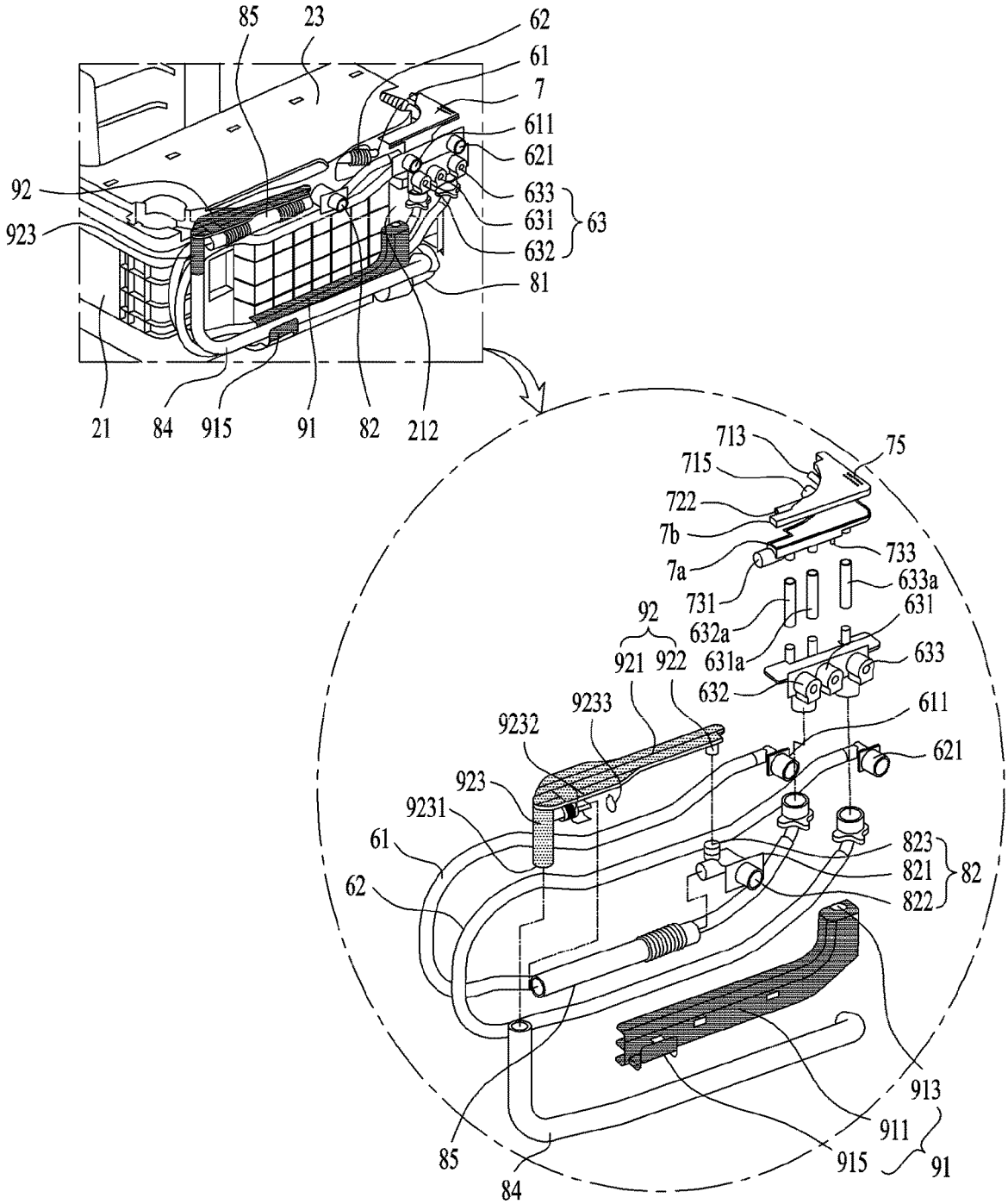
FIGS. 6 and 7 show an example of a water supply flow channel, a drain flow channel, a flow channel support, and a dispenser.

As shown in FIG. 6, the dispenser 7 may be fixed at a rear portion of the drawer cover 23 (a portion at which the rear cover is located), and may be connected to the first connection pipe 61 and the second connection pipe 62 through a connection pipe control portion 63. The dispenser 7 may be disposed in an area not exposed to the outside of the cabinet 1 even when the drawer body 21 is extended out of the cabinet 1 of a space provided by the drawer cover 23. This is to minimize a volume of the laundry treating apparatus by utilizing a space of the drawer 2 that is not exposed to the outside of the cabinet.

Figure 7:
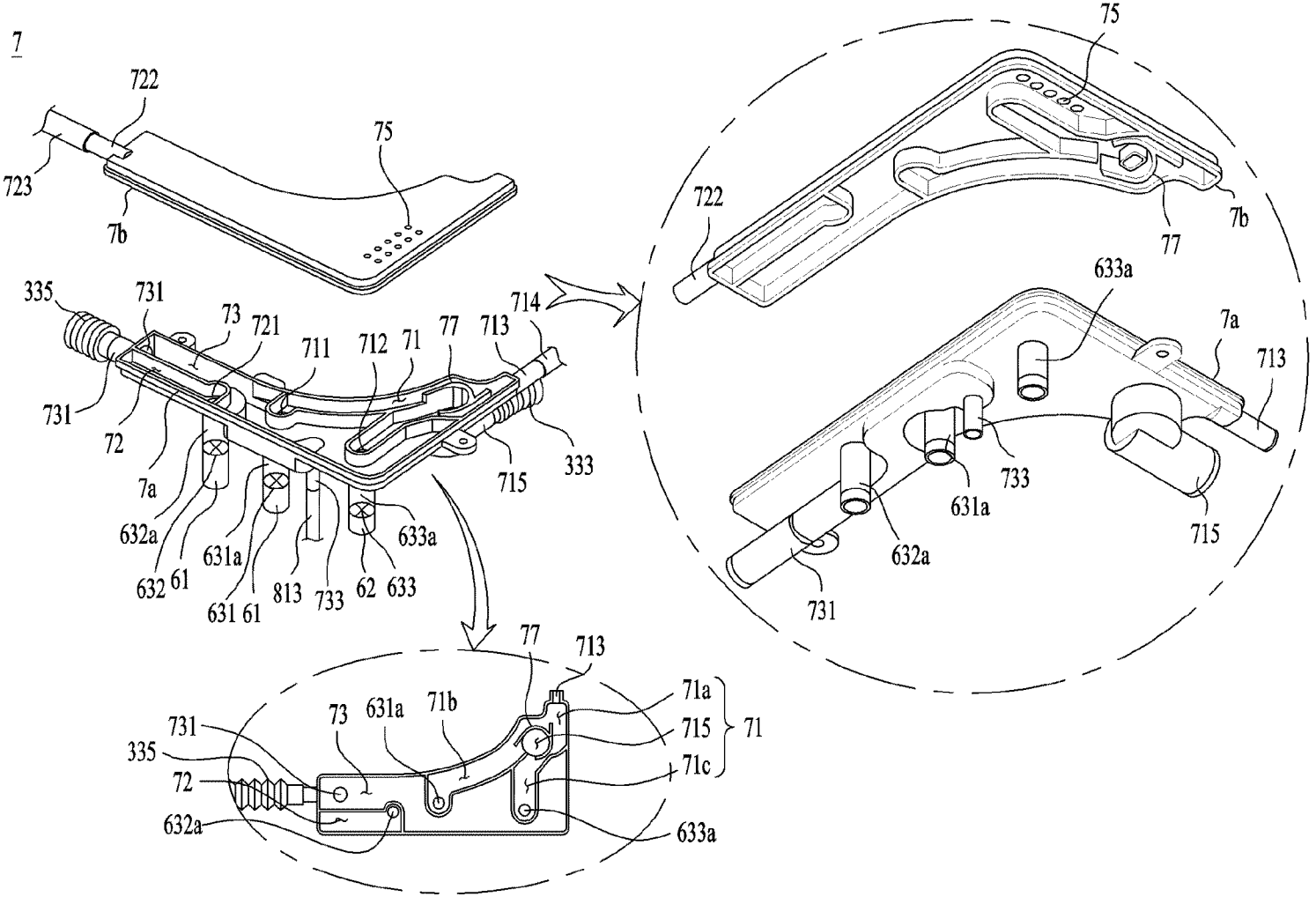

As shown in FIG. 7, the dispenser 7 may include a flow channel body 7*a* fixed to the drawer cover 23, and a flow channel cover 7*b* that is fixed to the flow channel body to form a top face of the dispenser.

In the flow channel body 7*a*, water supply flow channels 71 and 72 that define a flow path of the water, and an exhaust flow channel 73 that defines a flow path of the air and defines a flow channel separated from the water supply flow channels may be defined. In this case, a cover through-hole 75 that discharges the air inside the exhaust flow channel 73 to the outside of the dispenser 7 may be defined in the flow channel cover 7*b*.

The water supply flow channels may include a first water supply flow channel 71 connected to each of the first connection pipe 61 and the second connection pipe 62, and a second water supply flow channel 72 connected only to the first connection pipe 61 and defining a flow channel separated from the first water supply flow channel 71 and the exhaust flow channel 73.

The connection pipe control portion 63 may be constructed to include a first connection pipe control portion 631, 631*a*, 632, and 632*a* that control supply of the water supplied from the first connection pipe 61 to the first water supply flow channel 71 and the second water supply flow channel 72, and a second connection pipe control portion 633 and 633*a* that control supply of the water supplied from the second connection pipe 62 to the first water supply flow channel 71.

The first connection pipe control portion may be constructed to include a first control pipe 631*a* that connects the first connection pipe 61 to the first water supply flow channel 71, a first valve 631 that controls opening and closing of the first control pipe in response to a control signal from a controller C, a second control pipe 632*a* that connects the first connection pipe 61 to the second water supply flow channel 72, and a second valve 632 that controls opening and closing of the second control pipe based on the control signal from the controller C.

The second connection pipe control portion may be constructed to include a third control pipe 633*a* that connects the second connection pipe 62 to the first water supply flow channel 71, and a third valve 633 that controls opening and closing of the third control pipe in response to the control signal from the controller C.

In conventional laundry treating apparatuses, the first connection pipe control portion is fixed to the first water source connector 611 or the rear cover 18, and the second connection pipe control portion is fixed to the second water source connector 621 or the rear cover 18. However, in the laundry treating apparatus 100 in the present application, the first connection pipe control portion 631, 631*a*, 632, and 632*a* and the second connection pipe control portion 633 and 633*a* are fixed to the drawer. When the controller C, the first connection pipe control portion 631, 631*a*, 632, and 632*a*, and the second connection pipe control portion 633 and 633*a* are fixed to the body rear face 212, it is possible to minimize a risk that an electric wire that connects the controller C and each of the valves 631, 632, and 633 is tangled inside the cabinet 1.

The first water supply flow channel 71 has a first flow channel first discharge port 713 and a first flow channel second discharge port 715. A first flow channel water supply pipe 714 that supplies water to the first detergent flow channel 234 may be fixed to the first flow channel discharge port 713, and a tub water supply pipe 333 that supplies water to the tub 3*a* may be fixed to the first flow channel second discharge port 715. The first flow channel first discharge port 713 and the first flow channel second discharge port 715 may be disposed on the flow channel body 7*a* or may be disposed on the flow channel cover 7*b*. FIG. 7 shows a case in which the first flow channel first discharge port 713 and the first flow channel second discharge port 715 are disposed on the flow channel body 7*a* as an example.

In this case, the first water supply flow channel 71 may include a first flow channel defining portion 71*a* having the first flow channel first discharge port 713, a second flow channel defining portion 71*b* that connects the first flow channel defining portion 71*a* with the first control pipe 631*a*, and a third flow channel defining portion 71*c* that connects the first flow channel defining portion 71*a* with the third control pipe 633*a*. Accordingly, the water of the first temperature and the water of the second temperature may be supplied to the first water supply flow channel 71.

The first flow channel second discharge port 715 may be located at a point where the second flow channel defining portion 71*b* and the third flow channel defining portion 71*c* intersect each other. This is to allow the water supplied from the first control pipe 631*a* to also flow to the tub water supply pipe 333 and allow the water supplied from the third control pipe 633*a* to also flow to the tub water supply pipe 333.

A C-shaped flow channel guide 77 that surrounds the first flow channel second discharge port 715 may be further disposed on the flow channel body 7*a*. The flow channel guide 77 is constructed to protrude from a bottom face of the flow channel body 7*a* toward the flow channel cover 7*b*. A first free end of the flow channel guide 77 may be located in the second flow channel defining portion 71*b*, and a second free end of the flow channel guide 77 may be located in the third flow channel defining portion 71*c*.

The flow channel guide 77 is means for supplying some of water introduced into the second flow channel defining portion 71*b* and the third flow channel defining portion 71*c* to the first flow channel second discharge port 713, and guiding the rest to the first flow channel second discharge port 715. Therefore, the dispenser 7 having the above-described structure may supply the water to the first detergent flow channel 234 and the tub 3*a* at the same time (may shorten a water supply time).

The second water supply flow channel 72 is constructed to receive the water of the first temperature through the second control pipe 632*a* (connected to the first connection pipe), and the water inside the second water supply flow channel 72 is discharged through a second flow channel discharge hole 722. The second flow channel discharge hole 722 may be defined in the flow channel body 7*a* or may be defined in the flow channel cover 7*b*.

A second flow channel water supply pipe 723 that supplies water to the second detergent flow channel 235 is fixed to the second flow channel discharge hole 722. When the detergent storage 239 is disposed in the second detergent flow channel 235, the second flow channel water supply pipe 723 may be formed as a hose that connects the second flow channel discharge hole 722 with the storage body water supply port 2392.

The exhaust flow channel 73 may be disposed between the first water supply flow channel 71 and the second water supply flow channel 72 to separate the two water supply flow channels 71 and 72. The exhaust flow channel 73 may have a tub communication hole 731, and the tub communication hole 731 may be connected to the tub exhaust hole 334 through the tub exhaust pipe 335. Accordingly, air inside the tub 3*a* may flow to the cabinet 1 through the tub exhaust hole 334, the tub exhaust pipe 335, the tub communication hole 731, the exhaust flow channel 73, and the cover through-hole 75. When communicating the interior of the tub 3*a* with the interior of the cabinet (communicating the interior of the tub with outside air), a problem of the water remaining in the tub may be prevented (hygienic management of the tub and the drum is possible).

Further, the exhaust flow channel 73 may further include a housing communication hole 733 defined therein. The housing communication hole 733 is connected to the housing exhaust hole 812 of the pump through the housing exhaust pipe 813 (see FIG. 5). Therefore, the air remaining inside the housing 811 of the pump may be discharged into the cabinet 1 through the housing exhaust pipe 813, the housing communication hole 733, the exhaust flow channel 73, and the cover through-hole 75.

The above-described dispenser 7 includes all of the flow channels 71 and 72 that supply the water to the space where the detergent is stored, the flow channel 71 that supplies the water to the tub, and the flow channel 73 that exhausts the air of the tub and the air of the pump. Accordingly, the present application may provide a laundry treating apparatus capable of minimizing a volume by minimizing an installation space of each of the flow channels 71, 72, and 73.

As shown in FIG. 4, the first flow channel water supply pipe 714 and the second flow channel water supply pipe 723 may be fixed to the drawer cover 23. To this end, the first cover 231 may include a first mounting groove 231*a* in which the first flow channel water supply pipe 714 is accommodated, and a second mounting groove 231*b* in which the second flow channel water supply pipe is accommodated defined therein. Unlike shown in the drawing, the first mounting groove and the second mounting groove may be defined in the second cover 236.

Because the laundry treating apparatus 100 of the above-described structure needs a motion of the drawer body 21 of being extended or retracted from or into the cabinet, the connection flow channels 61 and 62 or the drain flow channels 84, 85, and 86 may be entangled inside the cabinet 1.

In order to solve the above-described problem, the laundry treating apparatus 100 may further include a flow channel support 9. As shown in FIG. 5, the flow channel support 9 is constructed to include a first support 91 that is rotatably fixed to the drawer body 21 and positioned between the rear cover 18 and the body rear face 212, and a second support 92 that is rotatably fixed to the cabinet 1 and positioned between the rear cover 18 and the body rear face 212.

In this case, it is preferable that a free end of the second support 92 is separated from a free end of the first support 91. This is because, when the free end of the second support 92 and the free end of the first support 91 are connected to each other, not only the vibration of the drawer body 21 may be transmitted to the cabinet along the flow channel support 9, but also there is a possibility that a portion that connects the supports 91 and 92 with each other may be damaged by the vibration (a possibility that a problem in which it is difficult to extend or retract the drawer may occur).

When the flow channel support 9 is disposed, at least one of the connection flow channels 61 and 62 and the drain flow channels 84, 85 and 86 may be fixed to the first support 91 and the second support 92. FIG. 5 shows a case in which the connection flow channels 61 and 62 are fixed to the first support 91 and the second support 92, and the drain flow channels 84, 85, and 86 are also fixed to the first support 91 and the second support 92 as an example.

As shown in FIG. 6, the first support 91 may be formed as a bar rotatably fixed to the body rear face 212, and the second support 92 may be formed as a bar rotatably fixed to the fixing member 82.

That is, a fixed end (a first fixed end) of the first support 91 may be rotatably coupled to the body rear face 212, and a free end (a first free end) of the first support 91 may be positioned between the rear cover 18 and the body rear face 212. A fixed end (a second fixed end) of the second support 92 may be rotatably coupled to the fixing member 82, and a free end (a second free end) of the second support 92 may be positioned between the rear cover 18 and the body rear face 212. The second free end must not be connected to the first free end, and the second free end may be disposed at a point higher than the first free end or at a point lower than the first free end.

Figure 8B:
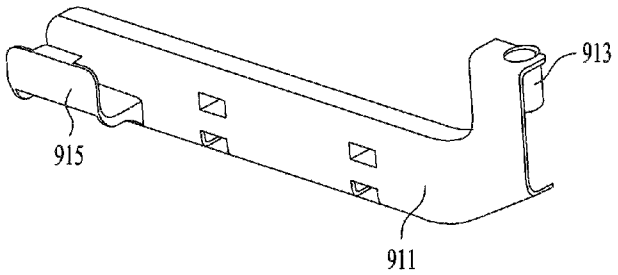
FIGS. 8A to 10 show an example of a first support and a second support in a flow channel support.
Figure 8A:
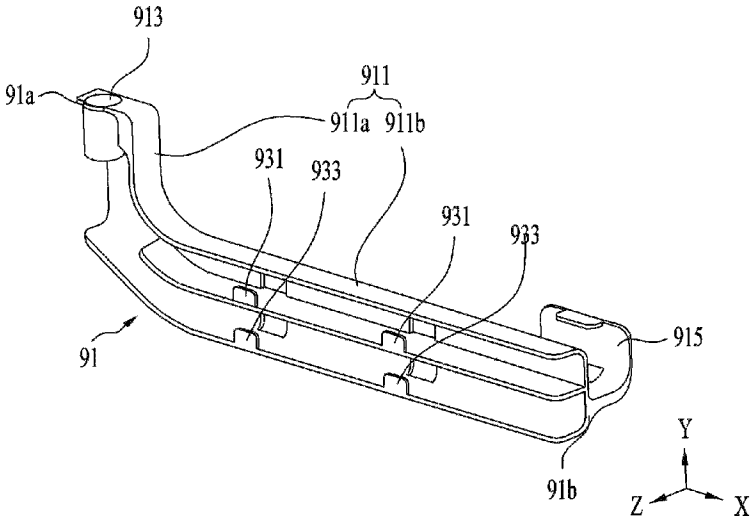

As shown in FIGS. 8A and 8B, the first support 91 includes a first support body 911 that provides a space in which the connection flow channels 61 and 62 and the drain flow channels 84 and 85 are supported, and a first support rotation shaft 913 that connects the first support body to the body rear face 212.

The first support body 911 fixed to the drawer body 21 may be disposed parallel to a width direction of the body rear face 212 (an X-axis direction) through the first support rotation shaft 913, and the first support rotation shaft 913 may be disposed at one end of the first support body 911. In this case, the body rear face 212 must include a first shaft support 317 (see FIG. 5) to which the first support rotation shaft 913 is rotatably coupled.

When the controller C (see FIG. 5) is fixed to the body rear face 212, the first support body 911 may include an inclined body 911*a* inclined downward from a first fixed end 91*a* (one end with the first support rotation shaft), and an extending body 911*b* (an area parallel to a width direction of the body rear face) extending from the inclined body toward the first free end 91*b*. This is to prevent the first support body from interfering with the controller C when the drawer 2 is inserted into the cabinet 1 (when the first support body is in contact with the body rear face).

Figure 9B:
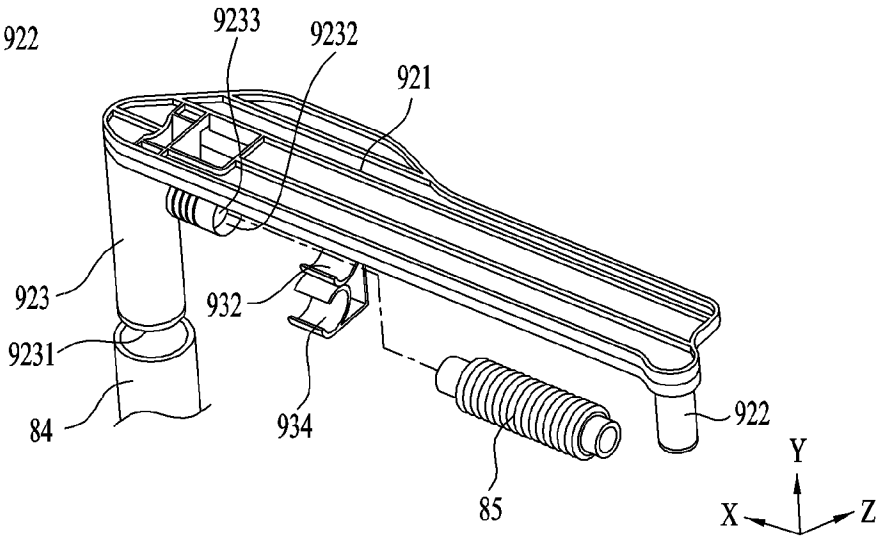
Figure 9A:
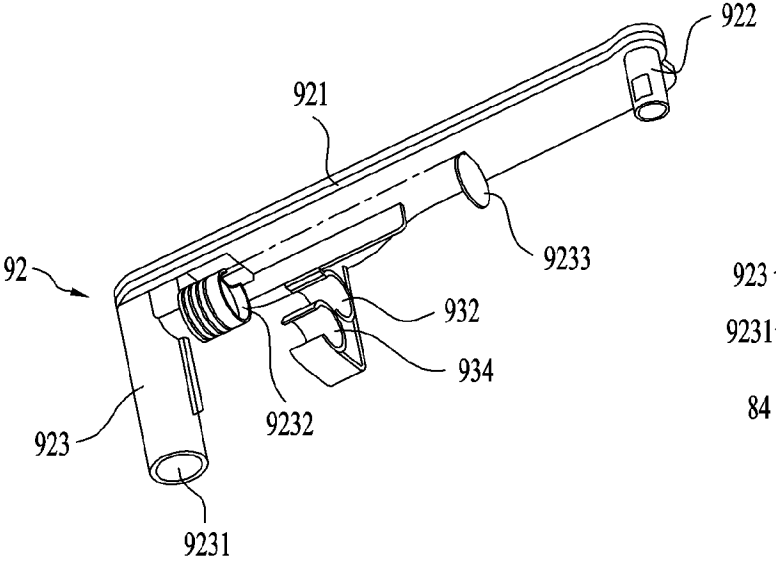

As shown in FIGS. 9A and 9B, the second support 92 may be constructed to include a second support body 921 that provides a space in which the connection flow channels 61 and 62 and the drain flow channels 84 and 85 are supported, and a second support rotation shaft 922 rotatably fixing the second support body 921 to the fixing member 82.

The second support body 921 may be disposed parallel to the width direction of the rear cover 18 (the X-axis direction), and the second support rotation shaft 922 may be disposed at a position at which the second support body 921 is positioned above the first support body 911 when the drawer panel 25 closes the drawer hole 113.

The second support rotation shaft 922 may be disposed at a second fixed end 92*a*, and the fixing member 82 may include a second shaft support to which the second support rotation shaft 922 is rotatably coupled. That is, as shown in FIG. 6, the fixing member 82 may include a second shaft support 823 disposed on the fixing body 821 and coupled to the second support rotation shaft 922.

A support flow channel 923 with an inlet 9231 through which liquid is introduced and an outlet 9232 through which the liquid is discharged may be disposed at the second free end 92*b*. In this case, the drain flow channels 84, 85, and 86 may be constructed to include a first drain pipe 84 that connects the housing 811 of the pump with the inlet 9231 of the support flow channel, a second drain pipe 85 that connects the outlet 9232 of the support flow channel with the fixing pipe 822 of the fixing member, and a third drain pipe 86 that guides the water discharged from the fixing pipe 822 to the sewer or ground (a surface on which the cabinet 1 is mounted).

As shown in FIGS. 9A and 9B, the second drain pipe 85 may be formed as a corrugate pipe having a structure stretchable in a longitudinal direction, or a pipe made of a material (rubber or the like) that is easily stretchable in the longitudinal direction. This is to minimize a problem that durability of the second drain pipe 85 is deteriorated by an external force input to the second drain pipe 85 when the second support body 921 rotates. For the same reason, the first drain pipe 84 may also be formed as the corrugate pipe or the pipe made of the material that is easily stretchable in the longitudinal direction.

In order to prevent the water flowed to the second drain pipe 85 from flowing back to the first drain pipe 84, a check valve 9233 may be further disposed at the outlet 9232 of the support flow channel. The check valve 9233 may be a valve having any structure as long as the water is allowed to be discharged from the outlet 9232, but the water is blocked from flowing into the outlet 9232.

As shown in FIGS. 8A and 8B, the first support body 911 has a drain pipe fixing portion 915 to which the first drain pipe 84 is fixed. Because the second drain pipe 85 is fixed to the second support body 921, the drain pipe fixing portion 915 is preferably disposed on a face facing the rear cover 18 of the space provided by the first support body.

To facilitate coupling and separation of the first support body 911 and the first drain pipe 84, the drain pipe fixing portion 915 may be formed as a U-shaped bracket (in a structure that may minimize deflection of the first drain pipe) that supports a lower space of the first drain pipe 84 (a circumferential face located below a horizontal line passing through a center of the first drain pipe). In this case, the first drain pipe 84 will be detachable from the drain pipe fixing portion 915.

Further, the flow channel support 9 may include a first fastening portion 931 and 933 disposed on the first support body 91 and to which the connection flow channels 61 and 62 are detachably fixed, and a second fastening portion 932 and 934 disposed on the second support body 921 and to which the connection flow channels 61 and 62 are detachably fixed.

The first fastening portion may be constructed to include a first connection pipe first fastening portion 931 disposed on the first support body 911 and to which the first connection pipe 61 is detachably fixed, and a second connection pipe first fastening portion 933 disposed on the first support body 911 and to which the second connection pipe 62 is detachably fixed.

It is preferable that the first connection pipe first fastening portion 931 and the second connection pipe first fastening portion 933 are disposed on a face facing the body rear face 212 of the space provided by the first support body 911. This is because, as the connection pipe control portion 63 is fixed to the rear face 212 (body rear face) of the drawer in the above-described laundry treating apparatus 100, twist of the connection pipes 61 and 62 may be minimized when the first connection pipe first fastening portion 931 and the second connection pipe first fastening portion 933 are formed as described above.

It is preferable that the first connection pipe first fastening portion 931 and the second connection pipe first fastening portion 933 are arranged along a height direction of the first support body 911 (a Y-axis direction). That is, the first connection pipe first fastening portion 931 is preferably disposed to be positioned above or below the second connection pipe first fastening portion 933. This is to minimize a volume of the first support body 911 to which the connection pipes 61 and 62 are fixed (minimize a volume of the laundry treating apparatus).

Unlike as shown in the drawing, the first connection pipe first fastening portion 931 and the second connection pipe first fastening portion 933 may be fixed to one of a top face and a bottom face of the first support body 911. In addition, the first connection pipe first fastening portion 931 may be fixed to one of the top face and the bottom face of the first support body 911, and the second connection pipe first fastening portion 933 may be fixed to the other of the top face and the bottom face of the first support body 911.

As shown in FIGS. 9A and 9B, the second fastening portion may be constructed to include a first connection pipe second fastening portion 932 disposed on the second support body 921 and to which the first connection pipe 61 is detachably fixed, and a second connection pipe second fastening portion 934 disposed on the second support body 921 and to which the second connection pipe 62 is detachably fixed.

The first connection pipe second fastening portion 932 and the second connection pipe second fastening portion 934 may be fixed to a bottom face (a face facing the first support body) of the second support body 921. In order to minimize a volume of the second support body 921 to which the connection pipes 61 and 62 are fixed, it is preferable that the first connection pipe second fastening portion 932 is positioned above or below the second connection pipe second fastening portion 934.

To facilitate coupling or separation the connection pipes 61 and 62 to or from the second support body 92, the first connection pipe second fastening portion 932 and the second connection pipe second fastening portion 934 may be formed as C-shaped brackets. In this case, an opened section of the bracket may be directed in a direction facing the rear face 212 of the drawer body 21.

Although not shown in the drawing, the first connection pipe second fastening portion 932 and the second connection pipe second fastening portion 934 may be disposed on a top face of the support body 921, or may be disposed on a face directed in a direction facing the body rear face 212 of a space provided by the second support body 921.

Figure 10:
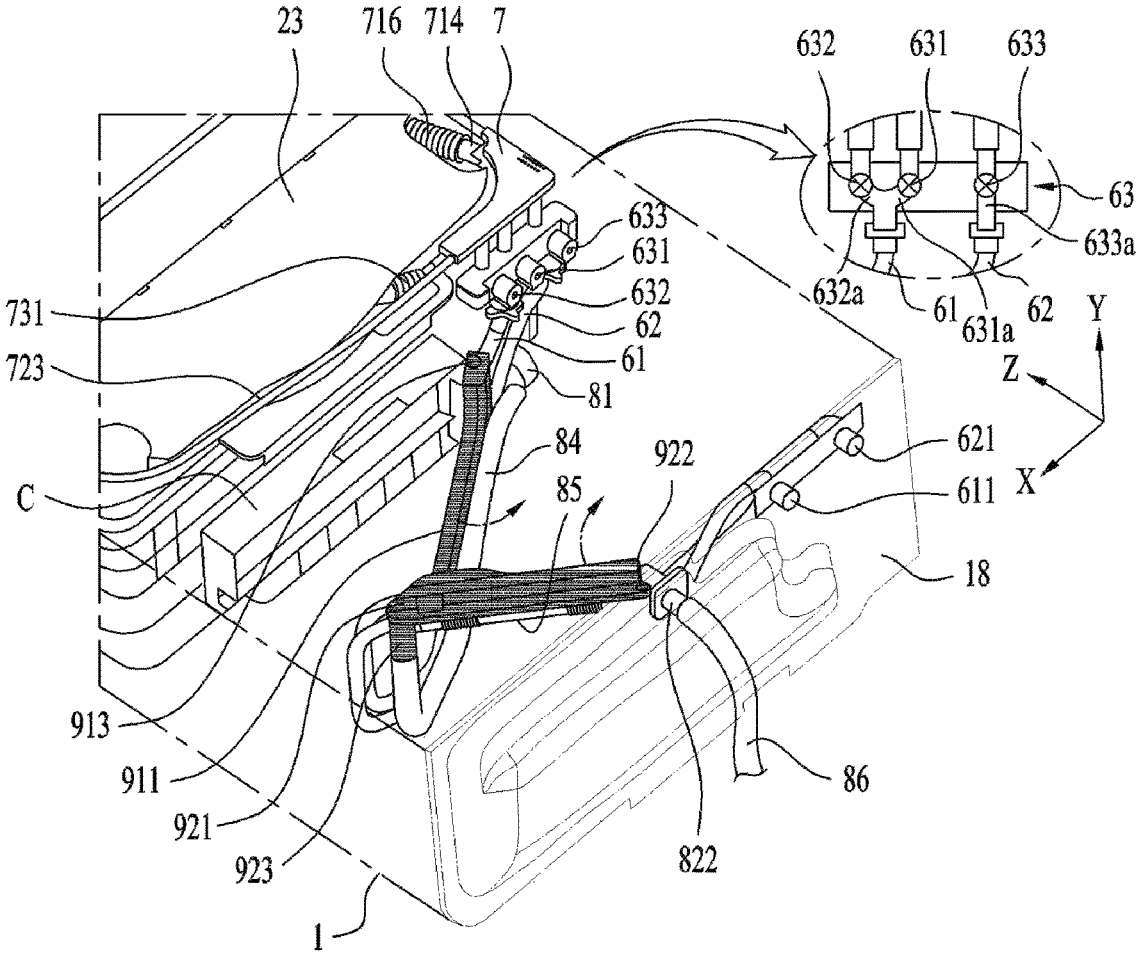

As shown in FIG. 10, when the drawer 2 is extended from the cabinet 1, the free end of the first support body 911 rotates counterclockwise, and the free end of the second support body 921 rotates clockwise. In this case, the free end of the first support body 911 will rotate in a plane parallel to the bottom face of the cabinet 1 (a X-Z plane), and the free end of the second support body 921 will also rotate in the plane parallel to the bottom face of the cabinet 1 (the X-Z plane). Although not shown in the drawing, the free end of the first support body 911 may rotate clockwise, and the free end of the second support body 921 may rotate counterclockwise.

FIG. 10 shows a case in which the plane in which the free end of the first support body 911 rotates is formed at a lower position than the plane in which the free end of the second support body 921 rotates, but the plane in which the free end of the first support body 911 rotates may be formed at a higher position than the plane in which the free end of the second support body 921 rotates (The first support may be changed to be located at a higher point than the second support).

The above-described embodiment has been described for the case in which the second support 92 is rotatably disposed on the fixing member 82 fixed to the rear cover 18 of the cabinet 1. However, the second support 92 may be rotatably disposed on the first side cover 16 or the second side cover 17 of the cabinet, the rear frame 12, or the like. Likewise, the first support 91 may be rotatably fixed to the drawer cover 23 or one of both side faces of the drawer.

Because the connection flow channels 61 and 62 and the drain flow channels 84 and 85 are supported by the flow channel support 9 in the laundry treating apparatus 100 of the above-described structure, it is possible to minimize the problem of the flow channels being entangled inside the cabinet 1 each time the drawer moves. In addition, because the free end of the first support body and the free end of the second support body are separated from each other in the laundry treating apparatus 100 described above, it is also possible to minimize the vibration of the drawer body 21 transmitted to the cabinet 1.

In the laundry treating apparatus 100 of the above structure, the door 4 must be opened after the drawer 2 is extended from the cabinet 1 to put the laundry into the drum 3*b* or withdraw the laundry stored in the drum. Among the conventional laundry treating apparatuses, there was one including the drawer, the tub disposed inside the drawer, the drum disposed inside the tub, and the door that opens and closes the inlet defined in the top face of the tub. The door disposed in the conventional laundry treating apparatus was in a structure of being coupled to a top face of the tub through a hinge.

The door rotatably fixed to the top face of the tub through the hinge has following problems. Because a free end of the door in the conventional laundry treating apparatus must be rotated in a direction away from the top face of the tub, in order for the door to open the inlet, the free end of the door had to be rotated to a point higher than the top face of the drawer. In the above-described conventional laundry treating apparatus, the drawer is not able to be retracted into the cabinet with the inlet open. This is because the drawer in the state in which the door opened the inlet may not be extended from the cabinet.

The fact that the drawer is not able to be retracted into the cabinet in the state in which the door opened the inlet means that the drawer must be extended from the cabinet when the tub and drum are dried by opening the inlet. This means that foreign substances may flow into the tub or the drum through the inlet when the water remaining in the tub and drum is to be evaporated. In addition, because the drawer must always be kept extended from the cabinet, there are disadvantages in that a space in front of the cabinet must be emptied as a space in which the drawer is extended, and durability of an apparatus that supports the drawer (such as a drawer support or the like) is deteriorated.

In order to solve the above-described disadvantages and problems, the door 4 in the laundry treating apparatus 100 is constructed to reciprocate between a first point of closing the inlet 331 and a second point of opening the inlet 331. In this case, the first point and the second point are set as points located in a space defined between the tub cover 33 and the drawer cover 23.

Figure 11:
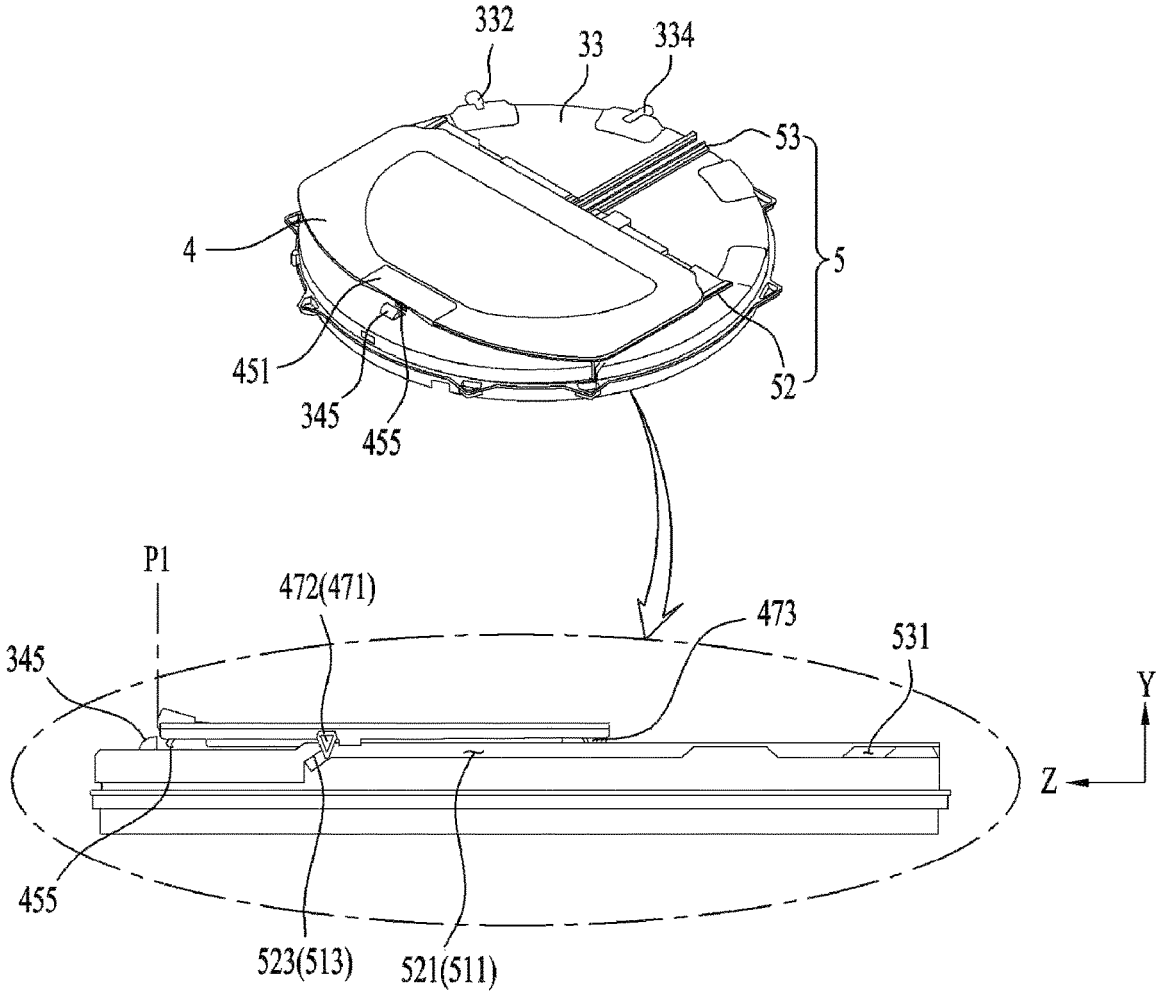
FIG. 11 shows a case in which a door is located at a first point of closing an inlet.
Figure 12:
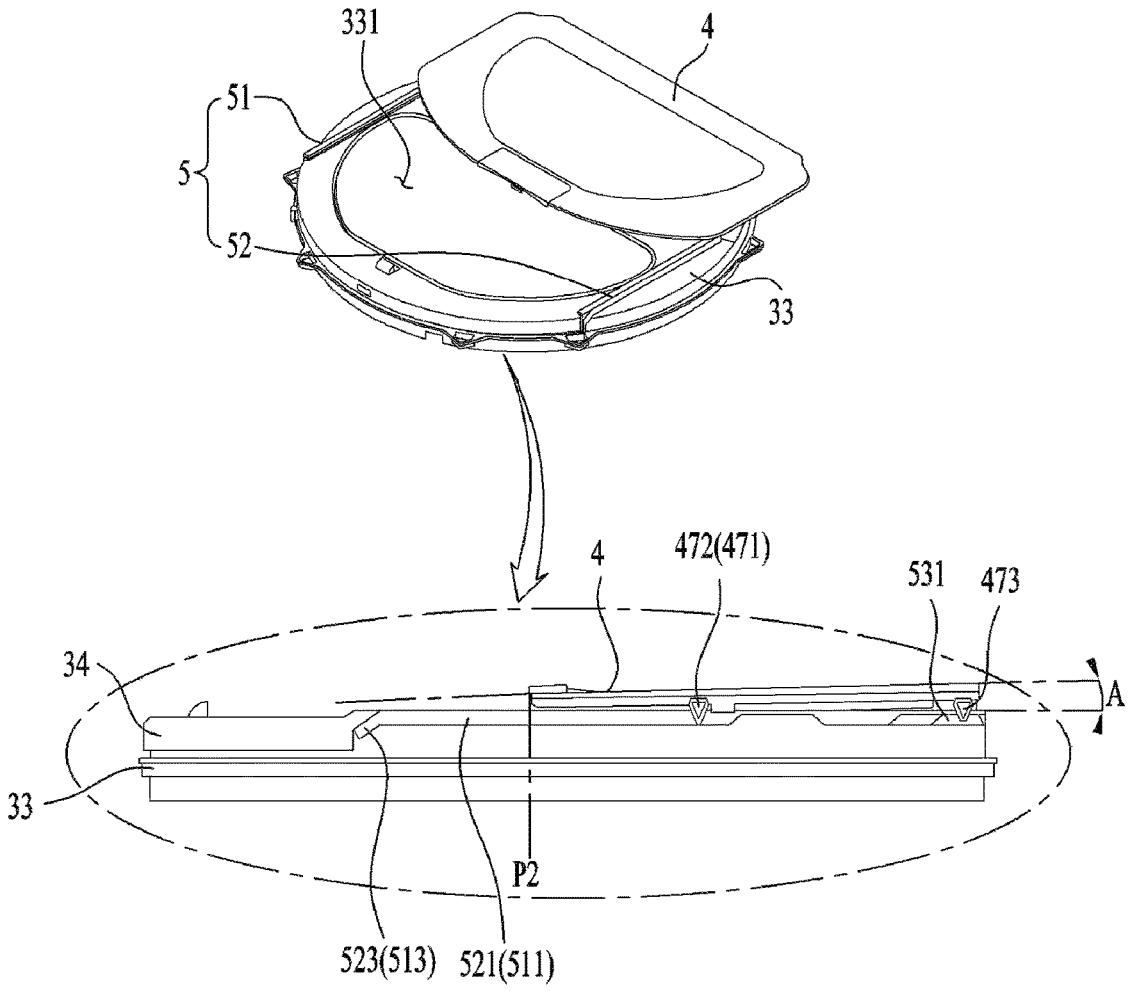
FIG. 12 shows a case in which the door is located at a second point of opening the inlet.

FIGS. 11 and 12 show an example of the laundry treating apparatus 100 capable of opening and closing the inlet 331 in the above-described manner. FIG. 11 shows that the door 4 is located at the first point P1 and closes the inlet 331, and FIG. 12 shows that the door 4 is positioned at the second point P2 and opens the inlet 331.

The laundry treating apparatus 100 may include the door 4 that closes the inlet 331, and a door guide 5 that allows the door to reciprocate between the first point P1 and the second point P2 but not to deviate from the interior of the drawer body 21.

Figure 13:
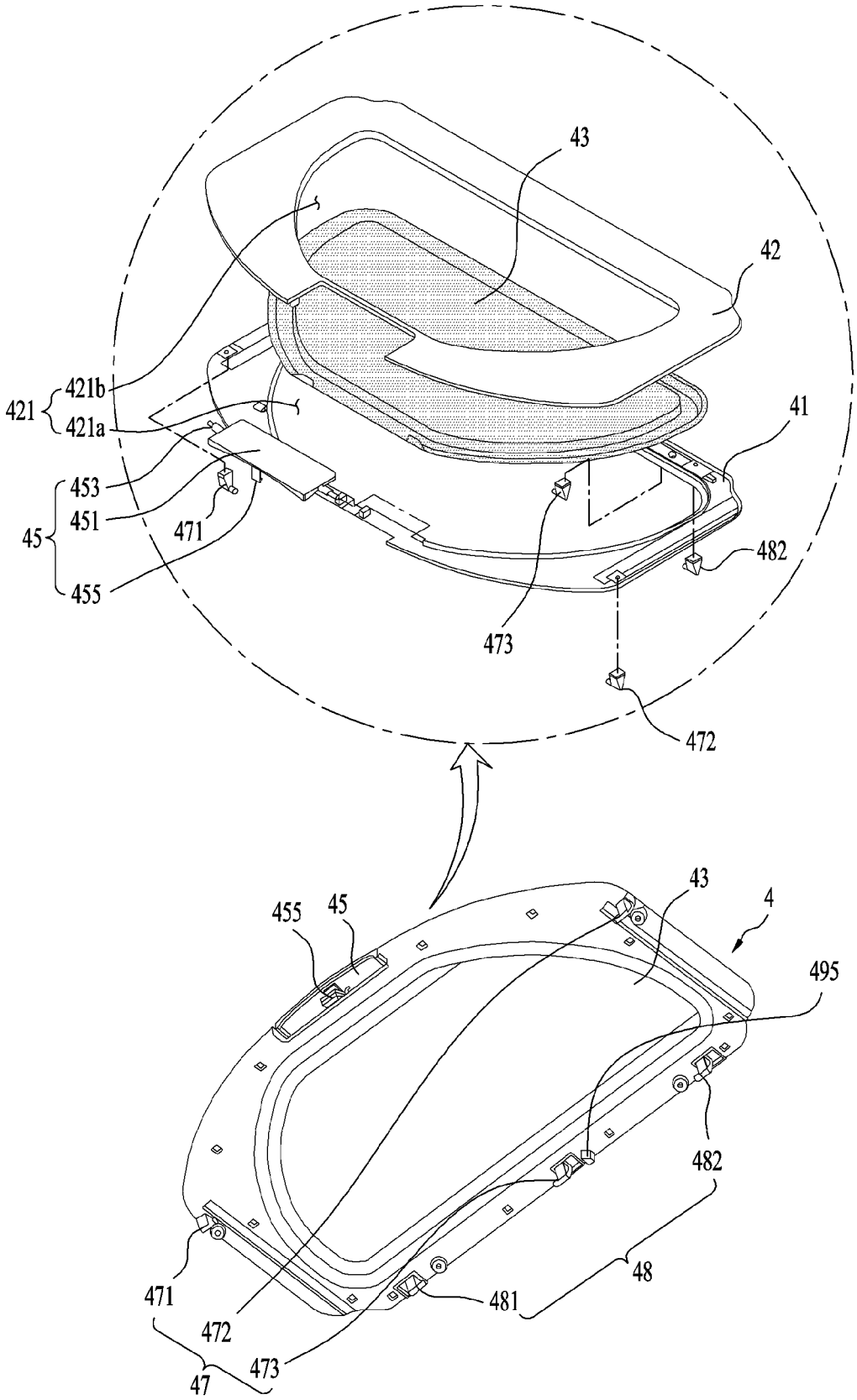
FIG. 13 shows an example of a door.

As shown in FIG. 13, the door 4 may be constructed to include a door frame 41 and 42 located in a space between the tub cover 33 and the drawer cover 23, and a closing portion 43 disposed in the door frame to close the inlet 331. The door frame 41 and 42 may include a base frame 41 positioned on the tub cover 33 to form a bottom face of the door, and a cover frame 42 that is fixed to the base frame and forms a top face of the door.

To allow the door to reciprocate between the first point P1 and the second point P2, the door frame 41 and 42 should be formed in shape that does not contact the drawer body 21 at the first point and the second point. In addition, to facilitate the insertion of the laundry when the door is positioned at the second point, it is preferable that the second point is set as a point at which 80% or more of the inlet 331 is opened.

The door frame 41 and 42 may include a frame through-hole 421 defined therein. The closing portion 43 may be fixed to the door frame 41 and 42 so as to be positioned in the frame through-hole 421. The closing portion 43 is constructed to protrude from the base frame 41 and be inserted into the inlet 331. The closing portion 43 may be formed in a shape of a pillar having a bottom face corresponding to a shape of the inlet 331. In order to identify the interior of the tub 3*a* from the outside of the drawer 2, the closing portion 43 may be made of a transparent material. In this case, the closing portion will serve as a window.

The frame through-hole 421 may be defined by a base frame through-hole 421*a* defined to penetrate the base frame and a cover frame through-hole 421*b* defined penetrate the cover frame. In this case, the closing portion 43 may include a closing portion body inserted into the inlet 331, and a flange fixed between the base frame 41 and the cover frame 42 such that the closing portion body is located in the frame through-hole 421.

Figure 14:
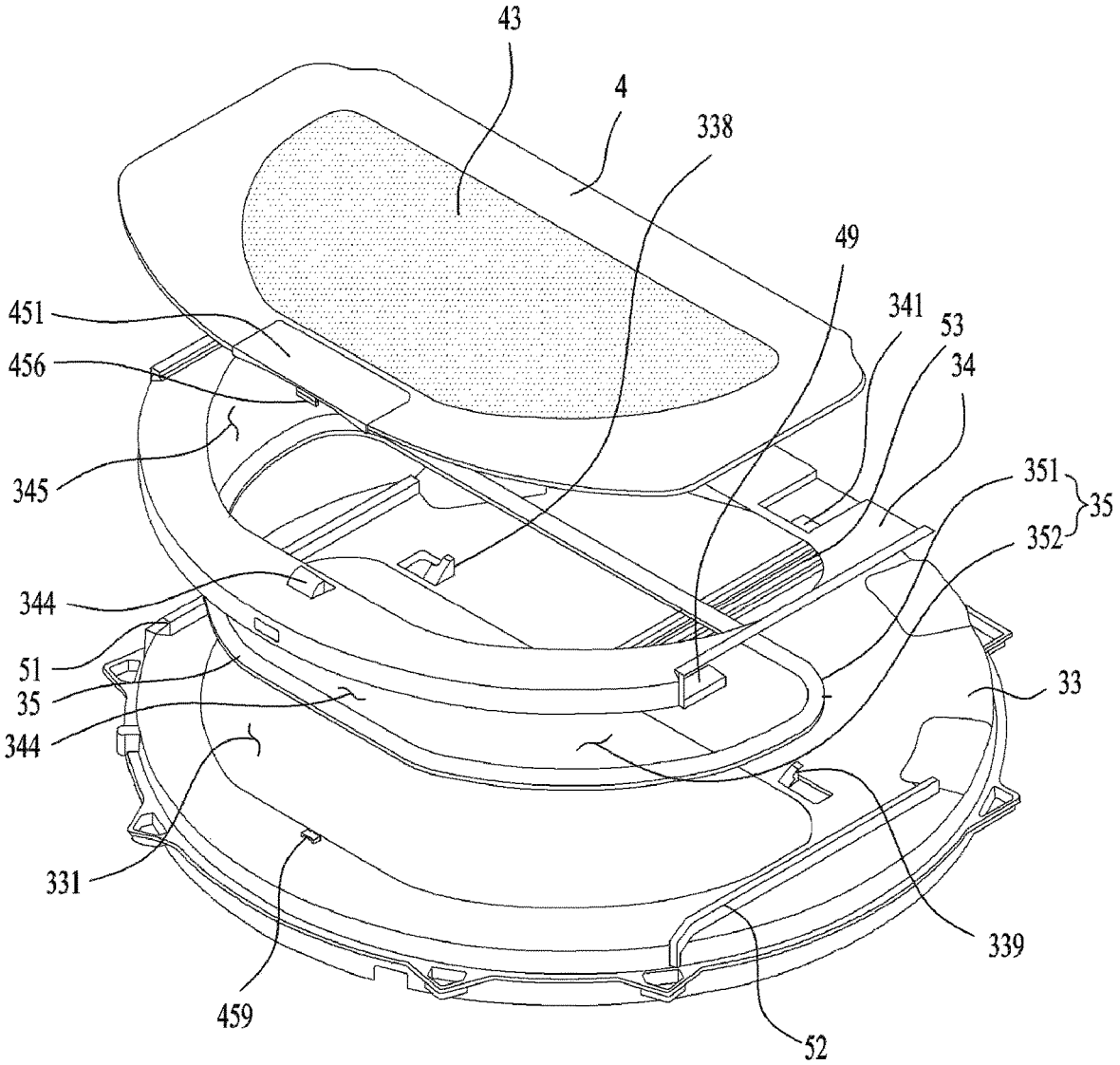
FIGS. 14 and 15 show an example of a coupling relationship between a tub cover, a door, and a gasket.

The door 4 may have a door lock 455 that detachably fixes the door frame 41 and 42 to the tub cover 33. As shown in FIG. 14, the door lock may be constructed to include a lock body 456 disposed on the door frame 41 and 42, and a lock fastening portion 459 disposed on the tub cover 33 and to which the lock body 456 is coupled.

When a handle 45 is disposed on the door frame 41 and 42, the lock body 456 may be fixed to the handle 45. As shown in FIG. 13, the handle 45 may be constructed to include a handle body 451 positioned at a front portion of the door frame 41 and 42, and a handle shaft 453 fixed between the base frame 41 and the cover frame 42 so as to rotatably fix the handle body to the door frame. In this case, the lock body 456 may be formed as a hook or the like protruding from the handle body 451 toward the tub cover 33.

As shown in FIG. 14, the lock fastening portion 459 is disposed in an area located in front of the inlet 331 in a space provided by the tub cover 33. Therefore, when the door closes the inlet 331 (when the door is located at the first point), the door lock 455 will fix a space in front of the door frame 41 and 42 (a space that is close to the drawer panel based on a horizontal line that passes through a center of the frame through-hole and is parallel to the X axis) to the tub cover 33 located in a space in front of the inlet 331 (a space that is close to the drawer panel based on a horizontal line that passes through a center of the inlet and is parallel to the X axis).

Figure 15:
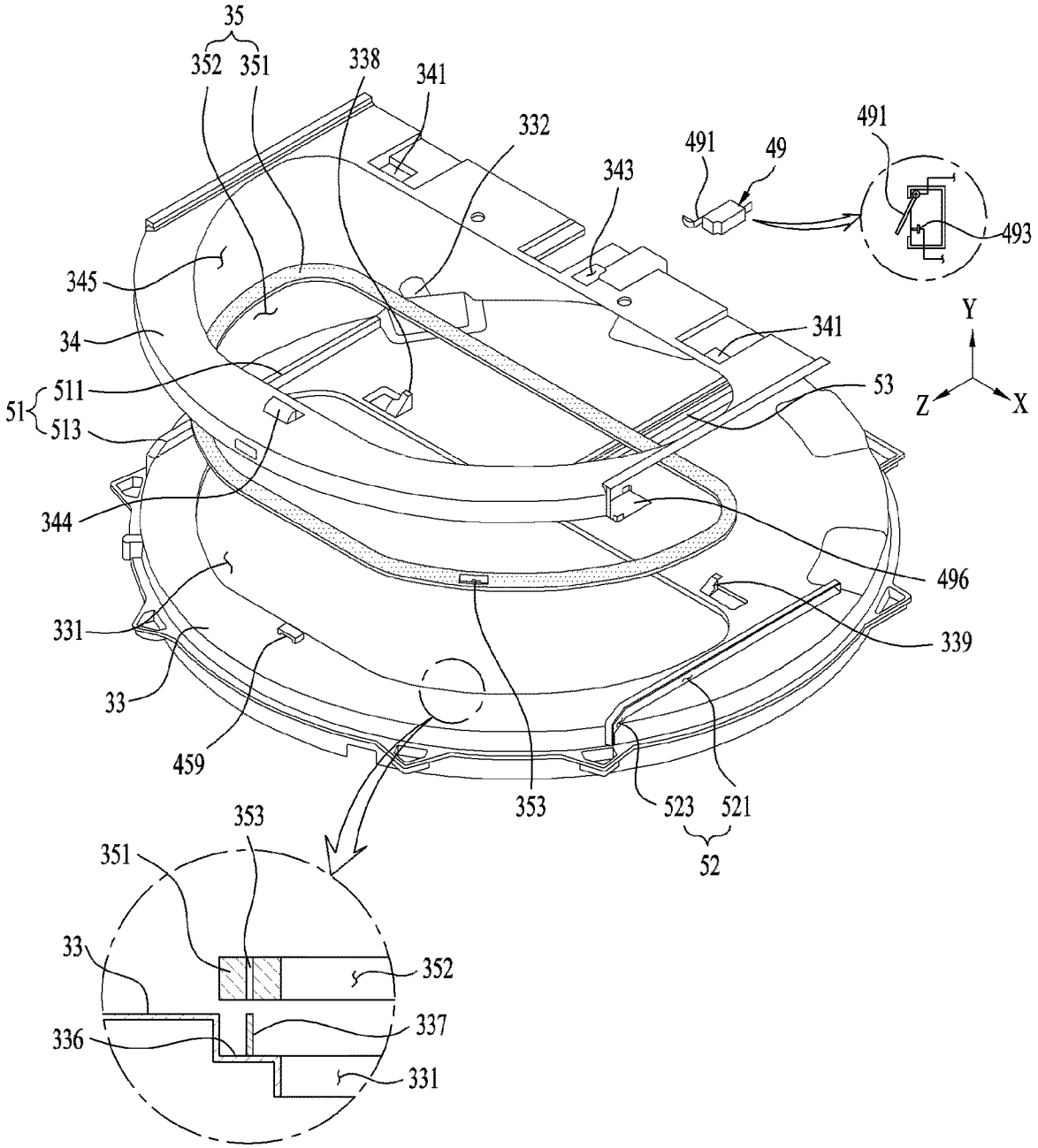

As shown in FIG. 15, the door guide 5 is constructed to include a first guide 51, a second guide 52, and a third guide 53 that provide a path along which the door 4 reciprocates between the first point P1 and the second point P2.

The first guide 51 and the second guide 52 may be respectively located in a space of the tub cover 33 to the left of the inlet 331 (a space that is close to the first side cover based on a horizontal line that passes through the center of the inlet and is parallel to the Z-axis) and a space of the tub cover 33 to the right of the inlet 331 (a space that is close to the second side cover based on the horizontal line that passes through the center of the inlet and is parallel to the Z-axis). In addition, the third guide 53 may be located in a rear space of the tub cover 33 (a space that is close to the body rear face based on the horizontal line that passes through the center of the inlet and is parallel to the X-axis), and be located between the first guide 51 and the second guide 52. The third guide 53 may extend from a rear end of the inlet 331 toward a rear end of the tub cover 33. The first guide 51, the second guide 52, and the third guide 53 are parallel to each other.

The door frame 41 and 42 has a slide 47 coupled to the door guide 5. As shown in FIG. 13, the slide 47 may be constructed to include a first slide 471 disposed on the base frame 41 and connected to the first guide 51, a second slide 472 disposed on the base frame 41 and connected to the second guide 52, and a third slide 473 disposed on the base frame 41 and connected to the third guide 53.

The first slide 471 and the second slide 472 are respectively on a left side (a side that is close to the first side cover based on the horizontal line that passes through the center of the frame through-hole and is parallel to the Z-axis) and a right side of the base frame 41 with the closing portion 43 interposed therebetween. In addition, the third slide 473 may be disposed on the base frame 41 so as to be located at the rear of the closing portion 43. Each of the slides 471, 472, and 473 may be composed of a slide body that is fixed to the base frame 41, and a sliding protrusion protruding from the slide body and inserted into each of the guides 51, 52, and 53.

When the closing portion 43 is constructed to close the inlet 331 by being inserted into the inlet 331, it is preferable that each of the guides 51, 52, and 53 includes a detachment path that guides the slide in a direction from the tub cover 33 to the drawer cover 23, and a transfer path that guides the slide from the detachment path to a rear portion of the tub cover 33.

Figure 16:
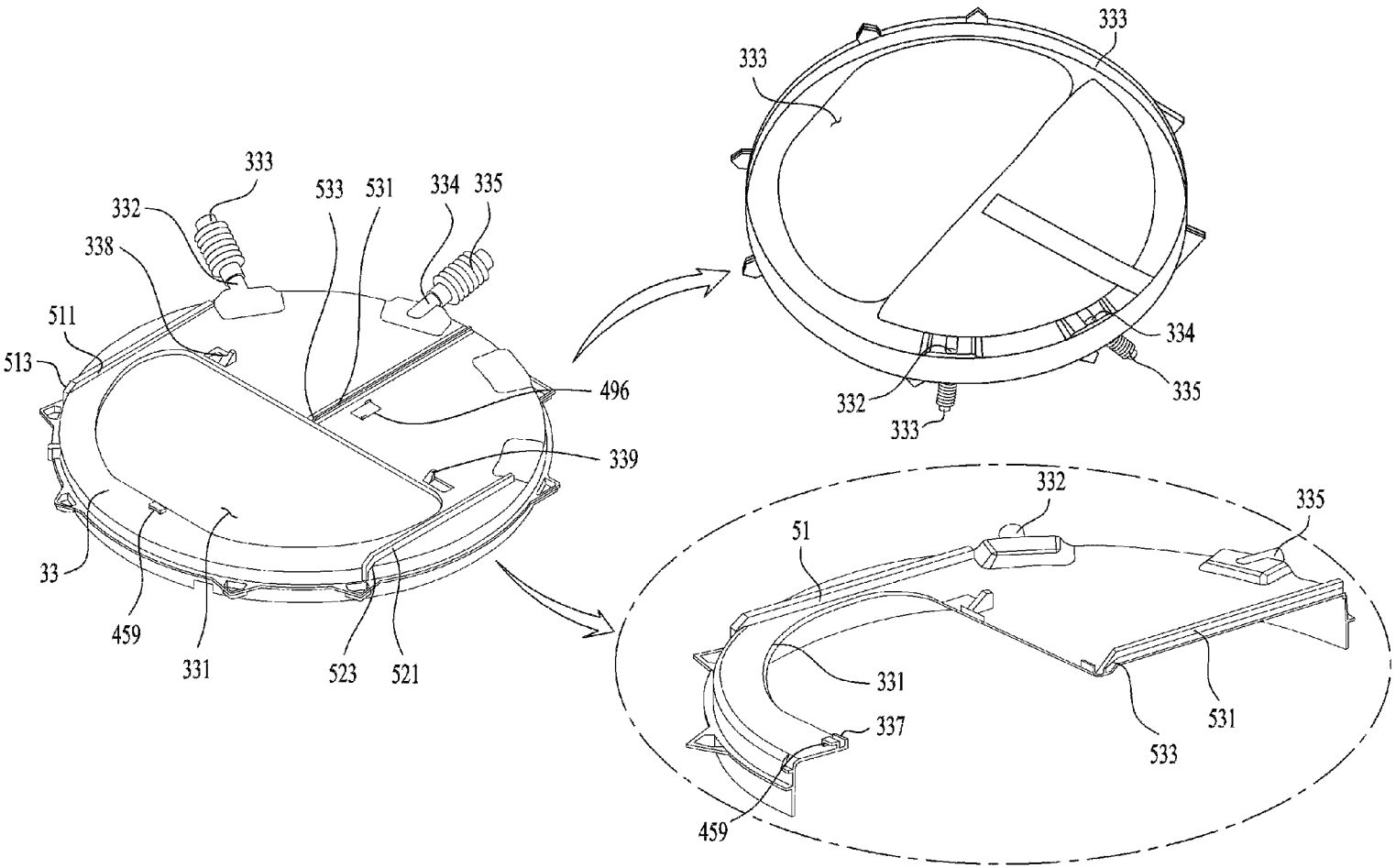
FIG. 16 shows an example of a tub cover.

That is, as shown in FIG. 16, the first guide 51 may be constructed to include a first detachment path 513 that guides the first slide 471 in the direction from the tub cover 33 to the drawer cover 23, and a first transfer path 511 that guides the first slide 471 from an end of the first detachment path 513 to the rear portion of the tub cover 33. Similarly, the second guide 52 may be constructed to include a second detachment path 523 that guides the second slide 472 in the direction from the tub cover 33 to the drawer cover 23, and a second transfer path 521 that guides the second slide 472 from an end of the second detachment path 513 to the rear portion of the tub cover 33. The third guide 53 may be constructed to include a third detachment path 533 that guides the third slide 473 in the direction from the tub cover 33 to the drawer cover 23, and a third transfer path 531 that guides the third slide 473 from an end of the third detachment path 533 to the rear portion of the tub cover 33.

In order to prevent the closing portion 43 from interfering with the tub cover 33 and to reduce a force required for the movement of the door 4 when the door 4 moves toward the first point P1 (see FIG. 11), the first detachment path 513, the second detachment path 523, and the third detachment path 533 may be inclined. That is, each of the first detachment path 513, the second detachment path 523, and the third detachment path 533 may be a path with an inclination to be further away from the tub cover 33 in a direction from the inlet 311 to the rear portion of the tub cover 33.

It is preferable that an inclination angle of the first detachment path 513, an inclination angle of the second detachment path 523, and an inclination angle of the third detachment path 533 are set to be the same. In addition, it is preferable that the first transfer path 511, the second transfer path 521, and the third transfer path 531 are parallel to each other along a moving direction of the door frame 41 and 42 (a moving direction of the drawer).

In one example, because the tub 3 may vibrate when the drum 3*b* rotates, and the closing portion 43 may be separated from the inlet 331 when the tub vibrates, the door 4 and the tub cover 33 may respectively further include a stopper and a stopper fastening portion that prevents the door 4 from easily deviating from the first point P1. The stopper fastening portion may be disposed on the tub cover 33 as means for limiting the movement of the door by being coupled to the stopper when the door 4 reaches the first point P1.

As shown in FIGS. 13 and 14, a stopper 48 may include a first stopper 481 and a second stopper 482 defined in the base frame 421*a*, and the stopper fastening portion may include a first stopper fastening portion 338 disposed on the tub cover 33 and to which the first stopper 481 is detachably coupled, and a second stopper fastening portion 339 to which the second stopper 482 is detachably coupled.

The first stopper 481 may be defined at a point located between the third slide 473 and the first slide 471 in the rear space of the base frame 41, and the second stopper 482 may be defined at a point located between the third slide 473 and the second slide 472 in the rear space of the base frame 41 (see FIG. 13).

In this case, the first stopper fastening portion 338 should be disposed at a point located between the third guide 53 and the first guide 51 in space at the rear of the inlet 331, and the second stopper fastening portion 339 should be disposed at a point located between the third guide 53 and the second guide 52 in the space at the rear of the inlet 331 (see FIG. 14).

Figure 17:
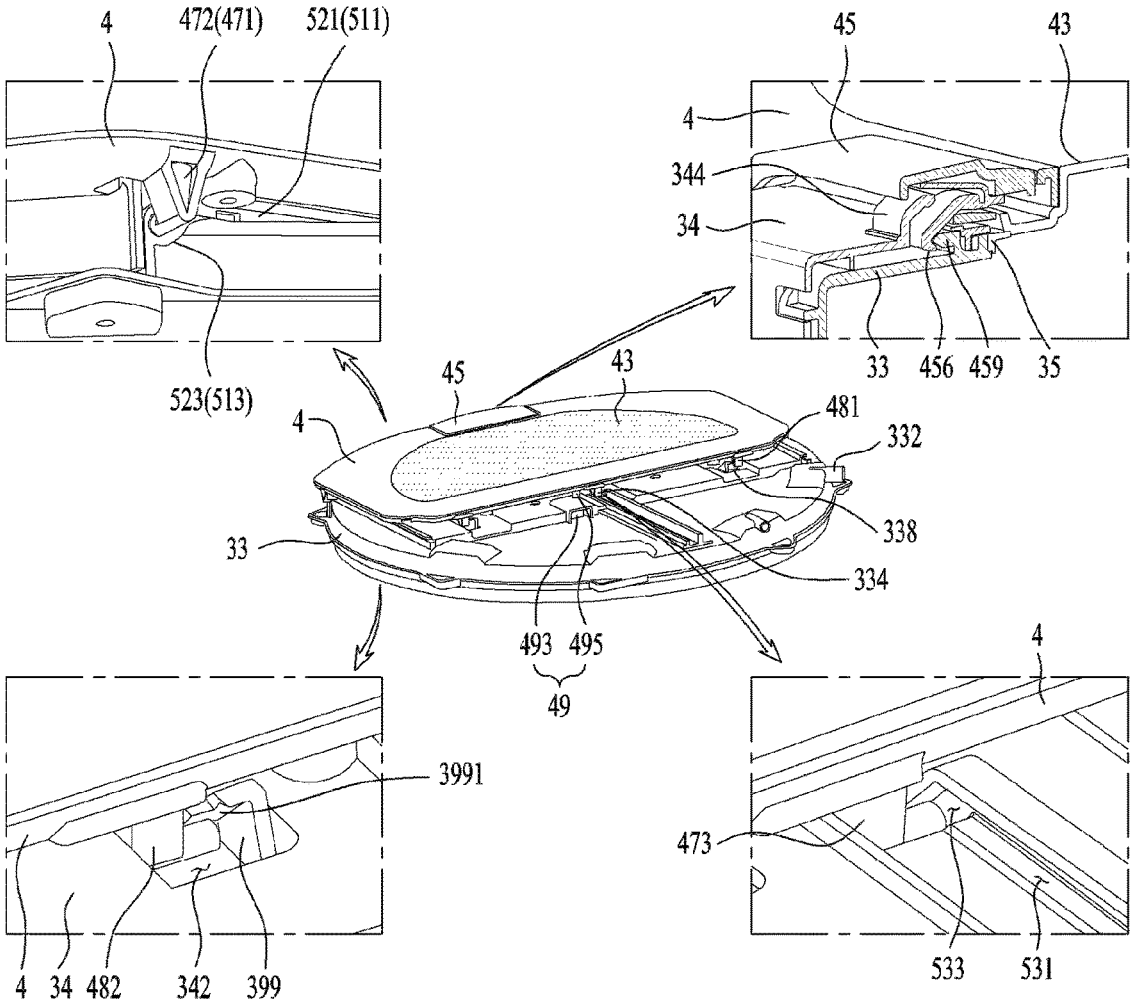
FIG. 17 shows an example of a slide, a door guide, and a stopper.

As shown in FIG. 17, the second stopper fastening portion 339 may include a second stopper guide 3391 that guides the second stopper 482 in the direction from the drawer cover 23 to the tub cover 33. Similarly, the first stopper fastening portion 338 may include a first stopper guide (not shown) that guides the first stopper 481 in the direction from the drawer cover 23 to the tub cover 33. It is preferable that an inclination angle of the first stopper guide and an inclination angle of the second stopper guide 3331 are set equal to the inclination angle of the detachment paths 513, 523, and 533.

When the door 4 is located at the first point P1 and closes the inlet 331, the lock body 456 of the door lock is fixed to the lock fastening portion 459, the first slide 471 is located at the lowest point of the first detachment path 513, the second slide 472 is located at the lowest point of the second detachment path 523, and the third slide 473 is located at the lowest point of the third detachment path 533. Further, the first stopper 481 is located at the lowest point of the first stopper guide, and the second stopper 482 is located at the lowest point of the second stopper guide 3391. Therefore, it means that the front area of the door frame 41 and 42 is fixed to the area of the tub cover 33 located in front of the inlet 331 through the door lock 45, the spaces on both sides of the door frame 41 and 42 are respectively fixed to both side faces of the tub cover 33 next to the inlet 331 by the first slide 471, the first guide 51, the second slide 472, and the second guide 52, and the rear area of the door frame 41 and 42 is fixed to the area of the tub cover 33 at the rear of the inlet 331 by the third slide 473, the third guide 53, the first stopper 481, the first stopper fastening portion 338, the second stopper 482, and the second stopper fastening portion 339. This means that the door 4 is fixed to the tub cover 33 through six fastening points.

The door in the conventional laundry treating apparatus was fixed to the tub cover through the door lock disposed on the handle, and two hinges disposed at the rear of the door. This means that the conventional door was fixed to the tub cover through a total of three fastening points. Because the number of fastening points in the laundry treating apparatus of the present application are greater than the number of fastening points in the conventional laundry treating apparatus, the laundry treating apparatus 100 may minimize a risk that the door 4 opens the inlet 331 by the vibration of the tub.

When the handle body 451 is rotated in such a state, the lock body 456 is separated from the lock fastening portion 459. When the lock body 456 is separated from the lock fastening portion 459, the front area of the door frame 41 and 42 will be separated from the tub cover 33. In addition, when the user pushes the door frame 41 and 42 to the rear of the drawer body, the door 4 will move from the first point P1 to the second point P2. As shown in FIG. 12, when the door is located at the second point P2, the inlet 331 will be opened.

Even when the inlet 331 is open, because the inlet 331 is located inside the drawer body 21, the user may retract or extend the drawer 2 in the state in which the inlet 331 is open into or from the cabinet 1. Therefore, the laundry treating apparatus 100 described above may dry the tub and the drum without extending the drawer from the cabinet.

In order to minimize the water remaining in the door 4, a rear portion of the door 4 positioned at the second point P2 may be positioned at a higher point than a front portion of the door. That is, at least one of the first transfer path 511, the second transfer path 521, and the third transfer path 531 may be inclined. FIG. 12 shows an example of a case in which the third transfer path 531 is inclined (A) toward the drawer cover 23 in a rearward direction of the tub cover 33.

In the above-described embodiment, the door guide 5 has been described as including all of the first guide 51, the second guide 52, and the third guide 53, but the door guide 5 may include only the first guide and the second guide (the slide only includes the first slide and the second slide), or may include only the third guide (the slide includes only the third slide).

In a state in which the laundry treating apparatus does not operate, it is not necessary to determine whether the door 4 has opened the inlet 331. However, it is preferable that the inlet 331 is controlled to be maintained in the closed state during the operation of the laundry treating apparatus (a state in which the drum is rotating, a state in which the water is being supplied to the tub, a state in which the water in the tub is being drained, and the like). The laundry treating apparatus 100 may further include a position sensing portion 49 to determine whether the door 4 has closed the inlet 331.

FIGS. 13 and 15 show an example of the position sensing portion 49. A case in which the position sensing portion 49 is composed of a pressing portion 495 (see FIG. 13) protruding from the door frame 41 and 42 toward the tub cover 33, and a signal generator 491 and 493 (see FIG. 15) that is disposed on the tub cover 33, and comes into contact with the pressing portion 495 when the door is located at the first point is shown as an example. As shown in FIG. 15, the signal generator may include a contact portion 491 that comes into contact with the pressing portion 495 when the door 4 is positioned at the first point, and a switch 493 that closes a circuit that generates a control signal when the contact portion is in contact with the pressing portion. The signal generator 491 and 493 having the above-described structure may be fixed to a sensor mounting portion 496 disposed on the tub cover.

Unlike the above, the signal generator 491 and 493 may transmit a control signal to the controller C when the door is located at the second point.

For sealing the inlet 331, a gasket 35 may be further disposed in the laundry treating apparatus 100. For fixing the gasket 35, the tub cover 33 may include a mounting groove 336 that defines a space in which the gasket 35 is supported therein, and a gasket cover 34 that prevents the gasket 35 from being separated from the mounting groove 336.

The mounting groove 336 may be defined as a ring-shaped groove surrounding the inlet 331, and the gasket cover 34 may be constructed to be detachable from the tub cover 33. The mounting groove 336 may have a fixing protrusion 337 that fixes the gasket 35 into the mounting groove.

The gasket cover 34 includes an inlet communication hole 345 defined therein in communication with the inlet 331. The above-described first stopper 481, second stopper 482, signal generator 491 and 493, and lock fastening portion 459 may be disposed below the gasket cover 34. The first stopper 481, the second stopper 482, the sensor mounting portion 496, and the lock fastening portion 459 are not exposed to the outside, thereby increasing durability of the apparatuses. In this case, the gasket cover 34 should include a cover first through-hole 341 and a cover second through-hole 342 that respectively expose the first stopper 481 and the second stopper 482 to the outside, a cover third through-hole 343 that exposes the signal generator to the outside, and a cover fourth through-hole 344 (lock through-hole) that exposes the lock fastening portion 459 to the outside defined therein.

Figure 18:
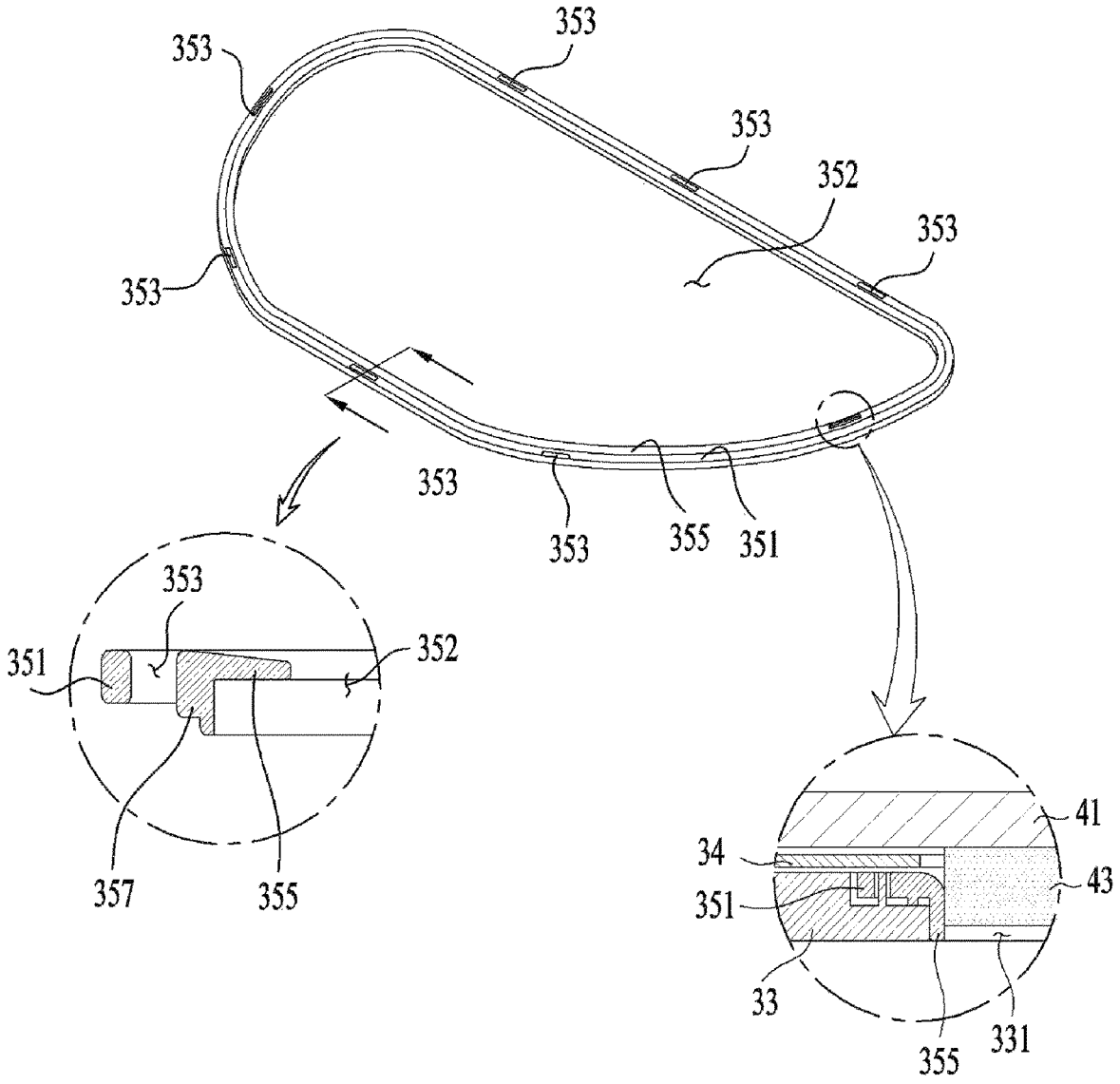
FIG. 18 shows an example of a gasket.

As shown in FIG. 18, the gasket 35 may be constructed to include a fastening body 351 seated in the mounting groove 336, a fastening body through-hole 352 defined to penetrate the fastening body 351 and in communication with the inlet 331, and a sealing body 355 protruding from the fastening body 351 toward the center of the inlet 331.

The fastening body 351 includes a fastening hole 353 including a plurality of fastening holes that is coupled to the fixing protrusion 337. The fastening hole 353 may include three front through-holes defined in an area of the fastening body 351 located in front of the inlet 331, three rear through-holes defined in an area of the fastening body 351 located at the rear of the inlet 331, and a left through-hole and a right through-hole located between the front through-holes and the rear through-holes and respectively located on areas to the left and to the right of the inlet 331. In this case, the fixing protrusion 337 should include three front fixing protrusions respectively inserted into the front through-holes, three rear fixing protrusions respectively inserted into the rear through-holes, a left fixing protrusion inserted into the left through-hole, and a right fixing protrusion inserted into the right through-hole.

The sealing body 355 may be formed in various shapes and structures as long as it may be compressed between the closing portion 43 and the inlet 331 when the door 4 is located at the first point P1.

The gasket 34 of the above-described structure seals the inlet 331 by being pressurized when the door 4 is located at the first point P1. That is, when the door is located at the first point, the sealing body 355 fills a gap between an outer circumferential face of the closing portion 43 and the inlet 331 while being pressurized toward an edge of the inlet 331 by the outer circumferential face of the closing portion 43.

The gasket that seals the inlet was also disposed in the conventional laundry treating apparatus. However, as mentioned above, the door in the conventional laundry treating apparatus was fixed to the tub cover through the door lock disposed on the handle and the two hinges disposed at the rear of the door. This means that an external force required to seal the inlet by deforming the gasket is supplied to the gasket through three points, and a gap between points to which the external force is input is wide. When the gap between the points that supply the external force to the gasket is wide, despite the presence of the gasket, the water in the tub may leak to the outside through the inlet 331.

As described above, the laundry treating apparatus 100 disclosed in the present application includes the slide 47, the door guide 5, the door lock 455, the stopper 48, and the stopper fastening portion 338 and 339. Therefore, the laundry treating apparatus 100 of the above-described structure may pressurize the gasket 35 at a minimum of 4 points and a maximum of 6 points.

The four points may be set as one door lock 455, three slides 471, 472, and 473, and the door guides 51, 52, and 53. In this case, the door lock 455 will press an area of the gasket 35 located in front of the inlet 331, and the third slide 473 and the third guide 53 will press the area of the gasket 35 located at the rear of the inlet 331. In addition, the first slide 471 and the first guide 51 will press the area of the gasket 35 to the left of the inlet 331, and the second slide 472 and the second guide 52 will press the area of the gasket 35 to the right of the inlet 331. The laundry treating apparatus 100 having such a structure may lower the risk of leaking water or air to the inlet 331 compared to the conventional laundry treating apparatus.

In one example, as the six points, in addition to the four points described above, the first stopper 481, the first stopper fastening portion 338, the second stopper 482, and the second stopper fastening portion 339 press the area of the gasket 35 at the rear of the inlet 331. Therefore, the structure of pressing the gasket 35 at the six points will be able to seal the inlet 331 more effectively.

To implement the above-described effect, the lock body 456 and the lock fastening portion 459 may be constructed to press the sealing body 355 in a direction in which the closing portion 43 is positioned when the lock body 456 is coupled to the lock fastening portion 459. In addition, the first detachment path 513, the second detachment path 523, and the third detachment path 533 may be constructed to press the sealing body 355 to the closing portion 43 when the lock body 456 is coupled to the lock fastening portion 459, and the stopper 481 and 482 and the stopper fastening portion 338 and 339 may be constructed to press the sealing body 355 to the closing portion 43 when the lock body 456 is coupled to the lock fastening portion 459 (when the stopper is coupled to the stopper fastening portion).

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A laundry treating apparatus comprising:

a cabinet having a front face with a drawer hole defined therein, and a rear cover defining a rear face of the cabinet;

a drawer including:

a drawer body configured to extend from the cabinet through the drawer hole, a drawer cover defining a top face of the drawer body, and a cover through-hole defined at the drawer cover, wherein the cover through-hole is configured to be exposed to an outside of the cabinet based on the drawer body being extended from the cabinet;

a tub including:

a tub body disposed inside the drawer and configured to receive water therein, a tub cover defining a top face of the tub body, and an inlet that passes through the tub cover, wherein the inlet is exposed to an outside of the drawer through the cover through-hole;

a drum rotatably disposed in the tub and configured to accommodate laundry;

a door configured to close the inlet; and a door guide configured to provide a path for the door to reciprocate between a first point where the inlet is closed and a second point where the inlet is opened, wherein the path is disposed in a space defined between the tub cover and the drawer cover, wherein the door guide is configured, based on the drawer being retracted into the cabinet, to position the door at the second point.

2. The laundry treating apparatus of claim 1, wherein the door comprises a door frame configured to close the inlet, and a slide coupled to the door frame, and wherein the door guide includes a detachment path configured to guide the slide in a direction from the tub cover towards the drawer cover, and a transfer path configured to guide the slide from the detachment path towards a rear portion of the tub cover.

3. The laundry treating apparatus of claim 2, wherein the detachment path is inclined in a direction from the inlet toward the rear portion of the tub cover.

4. The laundry treating apparatus of claim 1, wherein the door guide includes a first guide and a second guide that extend from a front portion of the tub cover toward a rear portion of the tub cover, and are parallel to each other with the inlet interposed therebetween, and wherein the door includes:

a door frame configured to close the inlet, a first slide fixed to the door frame and coupled to the first guide, and a second slide fixed to the door frame and coupled to the second guide.

5. The laundry treating apparatus of claim 4, wherein the first guide includes a first detachment path configured to guide the first slide in a direction from the tub cover toward the drawer cover, and a first transfer path configured to guide the first slide from the first detachment path toward a rear portion of the tub cover, and wherein the second guide includes a second detachment path configured to guide the second slide in the direction from the tub cover toward the drawer cover, and a second transfer path configured to guide the second slide from the second detachment path toward the rear portion of the tub cover.

6. The laundry treating apparatus of claim 1, wherein the door guide includes:

a first guide and a second guide that extend from a front portion of the tub cover toward a rear portion of the tub cover, and are facing each other with the inlet interposed therebetween; and a third guide extending from a rear end of the inlet toward a rear end of the tub cover, and positioned between the first guide and the second guide, wherein the door includes:

a door frame configured to close the inlet, a first slide fixed to the door frame and connected to the first guide, a second slide fixed to the door frame and connected to the second guide, and a third slide fixed to the door frame and connected to the third guide.

7. The laundry treating apparatus of claim 6, wherein the first guide includes a first detachment path configured to guide the first slide in a direction from the tub cover toward the drawer cover, and a first transfer path configured to guide the first slide from the first detachment path toward a rear portion of the tub cover, wherein the second guide includes a second detachment path configured to guide the second slide in the direction from the tub cover toward the drawer cover, and a second transfer path configured to guide the second slide from the second detachment path toward the rear portion of the tub cover, and wherein the third guide includes a third detachment path configured to guide the third slide in the direction from the tub cover toward the drawer cover, and a third transfer path configured to guide the third slide from the third detachment path toward the rear end of the tub cover.

8. The laundry treating apparatus of claim 7, wherein at least one of the first transfer path, the second transfer path, and the third transfer path is inclined such that a rear end of the door located at the second point is positioned at a higher point than a front end of the door.

9. The laundry treating apparatus of claim 8, wherein the third transfer path extends away from the tub cover to be inclined from the inlet toward the rear end of the tub cover.

10. The laundry treating apparatus of claim 2, further comprising:

a stopper defined in the door; and a stopper fastening portion disposed on the tub cover, wherein the stopper fastening portion is coupled to the stopper and configured to limit a movement of the door based on the door reaching the first point.

11. The laundry treating apparatus of claim 10, wherein the stopper fastening portion includes a stopper guide configured to guide the stopper in a direction from the drawer cover toward the tub cover, and wherein an inclination angle of the stopper guide is equal to an inclination angle of the detachment path.

12. The laundry treating apparatus of claim 1, further comprising:

a position sensing portion disposed on the tub cover and configured to sense (i) whether the door is positioned at the first point or (ii) whether the door is positioned at the second point.

13. The laundry treating apparatus of claim 12, wherein the position sensing portion includes:

a pressing portion protruding from the door toward the tub cover; and a signal generator disposed on the tub cover and configured to, based on the pressing portion being in contact with the signal generator, generate a control signal, wherein the pressing portion and the signal generator are configured to be in contact with each other based on the door being positioned at the first point.

14. The laundry treating apparatus of claim 1, wherein the second point is set as a point where 80% or more of the inlet is open.

15. The laundry treating apparatus of claim 13, wherein the signal generator is fixed to a sensor mounting portion disposed on the tub cover.

16. The laundry treating apparatus of claim 1, further comprising a gasket configured to seal the inlet, wherein the tub cover includes a mounting groove defining a space configured to support the gasket therein, and a gasket cover configured to restrict the gasket from being separated from the mounting groove.

17. The laundry treating apparatus of claim 16, wherein the mounting groove defines a ring-shaped groove that surrounds the inlet, and comprises a fixing protrusion, wherein the fixing protrusion fixes the gasket into the mounting groove.

18. The laundry treating apparatus of claim 17, wherein the gasket comprises:

a fastening body seated in the mounting groove;

a fastening body through-hole defined at the fastening body, wherein the fastening body through-hole is in communication with the inlet; and a sealing body protruding from the fastening body toward a center of the inlet.

19. The laundry treating apparatus of claim 18, wherein the fastening body comprises a fastening hole, wherein the fastening hole includes a plurality of fastening holes coupled to the fixing protrusion.

* * * * *